US010996577B2

(12) United States Patent
Nishikawa et al.

(10) Patent No.: US 10,996,577 B2
(45) Date of Patent: May 4, 2021

(54) TONER

(71) Applicant: CANON KABUSHIKI KAISHA, Tokyo (JP)

(72) Inventors: Koji Nishikawa, Susono (JP); Yojiro Hotta, Mishima (JP); Yasuhiro Hashimoto, Mishima (JP); Takaaki Furui, Tokyo (JP); Shotaro Nomura, Suntou-gun (JP); Yuujirou Nagashima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,179

(22) Filed: Dec. 27, 2019

(65) Prior Publication Data

US 2020/0209770 A1 Jul. 2, 2020

(30) Foreign Application Priority Data

Dec. 28, 2018 (JP) ..... JP2018-246999

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/097*** | (2006.01) |

(52) U.S. Cl.

CPC ..... *G03G 9/08711* (2013.01); *G03G 9/0819* (2013.01); *G03G 9/0823* (2013.01); *G03G 9/0827* (2013.01); *G03G 9/08704* (2013.01); *G03G 9/08755* (2013.01); *G03G 9/08773* (2013.01); *G03G 9/08782* (2013.01); *G03G 9/0904* (2013.01); *G03G 9/0906* (2013.01); *G03G 9/09725* (2013.01); *G03G 9/09775* (2013.01)

(58) Field of Classification Search

CPC ..... G03G 9/09725; G03G 9/09775
USPC ..... 430/108.3, 108.6
See application file for complete search history.

(56) References Cited

U.S. PATENT DOCUMENTS

| | | | |
|---|---|---|---|
| 5,601,913 | A | 2/1997 | Ohtani et al. |
| 6,586,147 | B2 | 7/2003 | Iida et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,112,393 | B2 | 9/2006 | Komoto et al. |
| 7,115,349 | B2 | 10/2006 | Iida et al. |
| 7,147,980 | B2 | 12/2006 | Itakura et al. |
| 7,273,686 | B2 | 9/2007 | Onuma et al. |
| 7,288,354 | B2 | 10/2007 | Moribe et al. |
| 7,306,889 | B2 | 12/2007 | Okubo et al. |
| 7,351,509 | B2 | 4/2008 | Moribe et al. |
| 7,422,832 | B2 | 9/2008 | Ogawa et al. |
| 7,455,947 | B2 | 11/2008 | Ida et al. |
| 7,459,253 | B2 | 12/2008 | Abe et al. |
| 7,544,457 | B2 | 6/2009 | Hashimoto et al. |
| 7,582,401 | B2 | 9/2009 | Ogawa et al. |
| 7,629,100 | B2 | 12/2009 | Okamoto et al. |
| 7,745,089 | B2 | 6/2010 | Okubo et al. |
| 7,767,370 | B2 | 8/2010 | Ishigami et al. |
| 7,816,063 | B2 | 10/2010 | Hashimoto et al. |
| 7,906,262 | B2 | 3/2011 | Ishigami et al. |
| 8,053,156 | B2 | 11/2011 | Abe et al. |
| 8,142,972 | B2 | 3/2012 | Hotta et al. |
| 8,227,162 | B2 | 7/2012 | Sano et al. |
| 8,247,147 | B2 | 8/2012 | Abe et al. |
| 8,367,289 | B2 | 2/2013 | Isono et al. |
| 8,426,094 | B2 | 4/2013 | Magome et al. |
| 8,440,382 | B2 | 5/2013 | Isono et al. |
| 8,497,054 | B2 | 7/2013 | Sugiyama et al. |
| 8,614,044 | B2 | 12/2013 | Matsui et al. |
| 8,652,737 | B2 | 2/2014 | Handa et al. |
| 8,778,581 | B2 | 7/2014 | Nonaka et al. |
| 8,778,585 | B2 | 7/2014 | Matsui et al. |
| 8,883,389 | B2 | 11/2014 | Matsui et al. |
| 8,916,319 | B2 | 12/2014 | Ikeda et al. |

(Continued)

FOREIGN PATENT DOCUMENTS

| | | |
|---|---|---|
| EP | 0 430 076 | 6/1991 |
| EP | 2 669 740 | 12/2013 |

(Continued)

OTHER PUBLICATIONS

U.S. Appl. No. 16/728,050, Tsuneyoshi Tominaga, filed Dec. 27, 2019.
U.S. Appl. No. 16/728,060, Kentaro Yamawaki, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.
U.S. Appl. No. 16/728,151, Masatake Tanaka, filed Dec. 27, 2019.

(Continued)

*Primary Examiner* — Mark A Chapman
(74) *Attorney, Agent, or Firm* — Venable LLP

(57) ABSTRACT

Toner comprising a toner particle containing binder resin and colorant, wherein fine particles A (organosilicon polymer particles containing an organosilicon polymer) and fine particles B are present at the toner particle surface, the organosilicon polymer has structure in which Si and O are alternately bonded to each other, portion of Si in the organosilicon polymer has $R^1$—$SiO_{3/2}$ structure, and content of the fine particles A, proportion for area of peak originating with silicon having the structure, volume resistivity of the fine particles B, total coverage ratio of the toner particle surface by the fine particles A embedded in the toner particle (A1) and the fine particles A not embedded in the toner particle (A2), percentage for area occupied by the fine particles A2, content of the fine particles B in the toner, and percentage for area occupied by the fine particles B embedded in the toner particle are prescribed range.

10 Claims, No Drawings

(56) References Cited

U.S. PATENT DOCUMENTS

| | | | |
|---|---|---|---|
| 8,927,188 | B2 | 1/2015 | Naka et al. |
| 8,940,467 | B2 | 1/2015 | Hashimoto et al. |
| 9,040,216 | B2 | 5/2015 | Fukudome et al. |
| 9,046,800 | B2 | 6/2015 | Hotta et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,217,943 | B2 | 11/2015 | Matsui et al. |
| 9,201,323 | B2 | 12/2015 | Nishikawa et al. |
| 9,213,250 | B2 | 12/2015 | Nomura et al. |
| 9,229,345 | B2 | 1/2016 | Ikeda et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,423,714 | B2 | 8/2016 | Kenmoku et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,778,583 | B2 | 10/2017 | Terauchi et al. |
| 9,804,514 | B2 | 10/2017 | Suzumura et al. |
| 9,829,818 | B2 | 11/2017 | Yoshiba et al. |
| 9,841,692 | B2 | 12/2017 | Hasegawa et al. |
| 9,897,932 | B2 | 2/2018 | Hotta et al. |
| 9,964,874 | B2 | 5/2018 | Suzumura et al. |
| 9,971,263 | B2 | 5/2018 | Fukucome et al. |
| 10,012,919 | B2 | 7/2018 | Matsui et al. |
| 10,101,683 | B2 | 10/2018 | Nishikawa et al. |
| 10,156,800 | B2 | 12/2018 | Tsuda et al. |
| 10,197,934 | B2 | 2/2019 | Matsui et al. |
| 10,228,627 | B2 | 3/2019 | Nagashima et al. |
| 10,228,630 | B2 | 3/2019 | Mizuguchi et al. |
| 10,241,430 | B2 | 3/2019 | Kimura et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,310,397 | B2 | 6/2019 | Sano et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0248110 | A1 | 9/2010 | Taguchi et al. |
| 2014/0220488 | A1 | 8/2014 | Hosoya et al. |
| 2015/0125790 | A1 | 5/2015 | Hotta et al. |
| 2015/0220013 | A1 | 8/2015 | Nishikawa et al. |
| 2016/0161874 | A1 | 6/2016 | Yamazaki et al. |
| 2016/0187799 | A1 | 6/2016 | Hiroshi et al. |
| 2016/0299446 | A1 | 10/2016 | Kuroki et al. |
| 2016/0378003 | A1 | 12/2016 | Arimura et al. |
| 2017/0123333 | A1 | 5/2017 | Kuroki et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |
| 2018/0329327 | A1 | 11/2018 | Yamawaki et al. |
| 2018/0329329 | A1 | 11/2018 | Nakamura et al. |
| 2019/0235402 | A1 | 8/2019 | Inoue et al. |
| 2020/0081361 | A1 | 3/2020 | Yoshiba et al. |

FOREIGN PATENT DOCUMENTS

| | | |
|---|---|---|
| EP | 2 818 932 | 12/2014 |
| EP | 2 853 945 | 4/2015 |
| EP | 2 860 585 | 4/2015 |
| EP | 3 095 805 | 11/2016 |
| EP | 3 480 661 | 5/2019 |
| JP | 2017-219823 | 12/2017 |
| JP | 2018-004804 | 1/2018 |
| JP | 2018-004949 | 1/2018 |
| WO | 2018/003749 | 1/2018 |

OTHER PUBLICATIONS

U.S. Appl. No. 16/728,157, Shohei Kototani, filed Dec. 27, 2019.
U.S. Appl. No. 16/728,171, Takaaki Furui, filed Dec. 27, 2019.
U.S. Appl. No. 16/701,260, Koji Nishikawa, filed Dec. 3, 2019.
U.S. Appl. No. 16/701,292, Tetsuya Kinumatsu, filed Dec. 3, 2019.
U.S. Appl. No. 16/701,412, Kosuke Fukudome, filed Dec. 3, 2019.

TONER

BACKGROUND OF THE INVENTION

Field of the Invention

The present invention relates to a toner used in image-forming methods such as electrophotography.

Description of the Related Art

A longer life and smaller size are being required of electrophotographic image-forming apparatuses, and to respond to these additional improvements in various properties are also being required of toner. In particular with regard to toner, a higher level of quality stability and thus improvements in the long-term durability are required from the standpoint of extending the life, while the volume of each unit must be reduced as much as possible from the standpoint of size reduction.

There have already been efforts with regard to size reduction to reduce the space taken up by the various units. In particular, the waste toner container, which recovers the untransferred toner on the photosensitive drum, can be reduced in size if the transferability of the toner can be improved, and as a consequence, various efforts have been made to improve the transferability.

In the transfer step, the toner on the photosensitive drum is transferred to media, e.g., paper, and it is crucial for separation of the toner from the photosensitive drum that the attachment force between the toner and photosensitive drum be reduced. There have been attempts to date to improve the transferability by reducing the attachment force through the design of the material in the vicinity of the toner surface layer. For example, an attachment force-reducing effect has been recognized for the addition to the toner surface layer of a material having an excellent releasability and/or lubricity. However, it has not been easy to maintain this low attachment force during the course of long-term use. As a consequence, the current situation is that achieving coexistence between a longer life and smaller size is quite difficult.

Japanese Patent Application Publication No. 2017-219823 proposes that contamination of the photosensitive drum can be improved through the external addition of lubricating particles to the toner particle.

Japanese Patent Application Publication No. 2018-004804 proposes that the transferability can be improved by controlling the attachment force by coating the toner particle surface with resin particles.

Japanese Patent Application Publication No. 2018-004949 proposes that the slipperiness of toner can be improved by the external addition of silicone particle type particles to the toner particle.

A certain effect on the transferability due to an improved lubricity or adhesiveness on the part of the toner is observed with this art.

SUMMARY OF THE INVENTION

However, there is room for additional investigations with regard to achieving coexistence between the long-term durability and maintenance of a low attachment force.

The present invention provides a toner that solves this problem. In specific terms, the present invention provides, through the addition of organosilicon polymer particles to toner particles having fine particles with controlled volume resistivity present at its surface layer, a toner that is resistant to reductions in the transferability even when used in a long-term durability test at high temperature and high humidity, which is a severe condition for the durability and transferability.

According to the first aspect of the present invention, a toner comprising:

a toner particle that contains a binder resin and a colorant, wherein fine particles A and fine particles B are present at a surface of the toner particle;

the fine particles A are organosilicon polymer particles containing an organosilicon polymer;

a content of the fine particles A in the toner is 0.5 mass % to 6.0 mass %;

the organosilicon polymer has a structure in which silicon atoms and oxygen atoms are alternately bonded to each other;

a portion of silicon atoms in the organosilicon polymer has a T3 unit structure as represented by the following formula (1)

$$R^1—SiO_{3/2} \quad (1)$$

where $R^1$ represents an alkyl group having 1 to 6 carbons or a phenyl group;

in a $^{29}$Si-NMR measurement using the organosilicon polymer particles, a proportion for an area of a peak originating with silicon having the T3 unit structure with reference to a total area of all Si element-originating peaks is 0.50 to 1.00;

the fine particles B have a volume resistivity of $5.0\times10$ Ωm to $1.0\times10^8$ Ωm;

of the fine particles A present at the surface of toner particle, designating fine particles present embedded in the toner particle as fine particles A1 and designating fine particles present not embedded in the toner particle as fine particles A2, a total coverage ratio of the surface of the toner particle by the fine particles A1 and the fine particles A2 is 10% to 70%;

in observation of cross sections of 100 particles of the toner using a transmission electron microscope (TEM), in a surface vicinity region from a location 30 nm inside from the surface of the toner particle to an outermost surface of the toner, a percentage for an area occupied by the fine particles A2 is at least 70 area % with reference to a total of an area occupied by the fine particles A1 and the area occupied by the fine particles A2;

a content of the fine particles B in the toner is 0.1 mass % to 3.0 mass %; and when, of the fine particles B present at the surface of the toner particle, designating fine particles present embedded in the toner particle as a fine particles B1 and designating fine particles present not embedded in the toner particle as fine particles B2, in observation of cross sections of 100 particles of the toner using a transmission electron microscope (TEM), in the surface vicinity region from the location 30 nm inside from the surface of the toner particle to the outermost surface of the toner, a percentage for an area occupied by the fine particles B2 is not more than 50 area % with reference to a total of an area occupied by the fine particles B1 and the area occupied by the fine particles B2, can be provided.

Moreover, according to the second aspect of the present invention, a toner comprising:

a toner particle that contains a binder resin and a colorant, wherein fine particles A and fine particles B are present at a surface of the toner particle;

the fine particles A are organosilicon polymer particles containing an organosilicon polymer;

a content of the fine particles A in the toner is 0.5 mass % to 6.0 mass %;

the organosilicon polymer has a structure in which silicon atoms and oxygen atoms are alternately bonded to each other;

a portion of silicon atoms contained in the organosilicon polymer has a T3 unit structure as represented by the following formula (1)

$$R^1—SiO_{3/2} \quad (1)$$

where $R^1$ represents an alkyl group having 1 to 6 carbons or a phenyl group;

in a $^{29}$Si-NMR measurement using the organosilicon polymer particles, a proportion for an area of a peak originating with silicon having the T3 unit structure with reference to a total area of all Si element-originating peaks is 0.50 to 1.00;

the fine particles B contain at least one of titanium oxide and strontium titanate;

of the fine particles A present at the surface of the toner particle, designating fine particles present embedded in the toner particle as fine particles A1 and designating fine particles present not embedded in the toner particle as fine particles A2, a total coverage ratio of the toner by the fine particles A1 and the fine particles A2 is 10% to 70%;

in observation of cross sections of 100 particles of the toner using a transmission electron microscope (TEM), in a surface vicinity region from a location 30 nm inside from the surface of the toner particle to an outermost surface of the toner, a percentage for an area occupied by the fine particles A2 is at least 70 area % with reference to a total of an area occupied by the fine particles A1 and the area occupied by the fine particles A2;

a content of the fine particles B in the toner is 0.1 mass % to 3.0 mass %; and of the fine particles B present at the surface of the toner particle, designating fine particles present embedded in the toner particle as fine particles B1 and designating fine particles present not embedded in the toner particle as fine particles B2, in observation of cross sections of 100 particles of the toner using a transmission electron microscope (TEM), in the surface vicinity region from the location 30 nm inside from the surface of the toner particle to the outermost surface of the toner, a percentage for an area occupied by the fine particles B2 is not more than 50 area % with reference to a total of an area occupied by the fine particles B1 and the area occupied by the fine particles B2, can be provided.

According to the present invention, a toner that is resistant to reductions in the transferability even when used in a long-term durability at high temperature and high humidity, which is a severe condition for the durability and transferability can be provided.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

As already noted, lowering the attachment force between the photosensitive drum and toner is important for improving the transferability of the toner from the photosensitive drum to the media. The attachment force may generally be classified into an electrostatic attachment force and a nonelectrostatic attachment force. The present inventors therefore investigated approaches that could lower both the electrostatic attachment force and nonelectrostatic attachment force of toner and thus would lower the attachment force for the toner, and that could also maintain the low attachment force during the course of long-term use.

Approaches for lowering the electrostatic attachment force of the toner were considered first. The electrostatic attachment force is known to be correlated with the charging performance of a toner. A toner must have an optimal charge quantity, but a high electrostatic attachment force occurs when the toner undergoes charge up during long-term use and the transferability may then be reduced. Establishing a structure that leaks excess charge was therefore thought to be important in order, during the course of long-term use, to maintain an optimal charge quantity and restrain charge up. Due to this, the application of fine particles having a controlled volume resistance value was considered.

However, when fine particles having a controlled volume resistance value, such as an external additive, were disposed at the outermost surface of toner, the occurrence of charge leakage was facilitated and in some cases maintenance of an optimal charge quantity was impaired. By therefore disposing fine particles having a controlled volume resistance value in the vicinity of the surface layer of the toner particle, it became possible to suppress charge up while maintaining an optimal charge quantity.

Approaches for lowering the nonelectrostatic attachment force of toner were then considered. The type of material is one factor that governs the nonelectrostatic attachment force. Due to this, the question was posed as to whether results would be obtained if a material providing a low nonelectrostatic attachment force were disposed at the toner surface, and it was then discovered as a result of extensive investigations that organosilicon polymer particles exhibit an excellent function as a material that reduces the nonelectrostatic attachment force. It is thought that organosilicon polymer particles have the effect of reducing the nonelectrostatic attachment force because they generally have an excellent release behavior. In addition, organosilicon polymer particles, because they also exhibit the characteristic feature of having an excellent charging performance, are also an excellent material for disposition at the toner surface from a charging performance standpoint.

Thus, through the further addition of organosilicon polymer particles to a toner particle having fine particles with a controlled volume resistance value disposed in the surface layer vicinity, the electrostatic attachment force and nonelectrostatic attachment force of the toner could each be reduced and the attachment force for the toner could be reduced.

It was additionally discovered that such a toner structure is also effective for maintaining a low attachment force during long-term use. An organosilicon polymer particle, because it exhibits elasticity, resists embedding into the toner particle—even when continuously subjected to a load from, e.g., the developing device, during long-term use—through the absorption of this load by the organosilicon polymer particle itself. It is thought that due to this the low attachment force of the toner can be maintained during long-term use.

With regard to materials other than organosilicon polymer particles, a reduction in the toner attachment force is obtained as an initial behavior also for the use of fine particles that exhibit an excellent releasability but are hard. However, embedding into the toner particle surface readily occurred with hard fine particles when the toner continuously received load from, e.g., the developing device, during long-term use, and structural disruption occurred in some cases for the fine particles having a controlled volume resistance value that were disposed in the vicinity of the toner particle surface layer. As a result, when charge up occurred during long-term use, the charge-leakage capability readily declined and the maintenance of a low attachment force was impaired.

The present inventors carried out extensive investigations from the perspectives referenced above. It was discovered as a result that reductions in the transferability are impeded even during long-term use in a durability test at high temperature and high humidity, which is a severe condition for transferability, through the addition of organosilicon polymer particles to toner particles having fine particles with a controlled volume resistance value disposed in the vicinity of the surface layer. The present invention was achieved as a result of this discovery.

Specifically, the present inventors achieved a toner comprising:

a toner particle that contains a binder resin and a colorant, wherein fine particles A and fine particles B are present at a surface of the toner particle;

the fine particles A are organosilicon polymer particles containing an organosilicon polymer;

a content of the fine particles A in the toner is 0.5 mass % to 6.0 mass %;

the organosilicon polymer has a structure in which silicon atoms and oxygen atoms are alternately bonded to each other;

a portion of silicon atoms in the organosilicon polymer has a T3 unit structure as represented by the following formula (1)

$$R^1—SiO_{3/2} \quad (1)$$

where $R^1$ represents an alkyl group having 1 to 6 carbons or a phenyl group;

in a $^{29}$Si-NMR measurement using the organosilicon polymer particles, a proportion for an area of a peak originating with silicon having the T3 unit structure with reference to a total area of all Si element-originating peaks is 0.50 to 1.00;

the fine particles B have a volume resistivity of $5.0\times10$ Ωm to $1.0\times10^8$ Ωm;

of the fine particles A present at the surface of toner particle, designating fine particles present embedded in the toner particle as fine particles A1 and designating fine particles present not embedded in the toner particle as fine particles A2, a total coverage ratio of the surface of the toner particle by the fine particles A1 and the fine particles A2 is 10% to 70%;

in observation of cross sections of 100 particles of the toner using a transmission electron microscope (TEM), in a surface vicinity region from a location 30 nm inside from the surface of the toner particle to an outermost surface of the toner, a percentage for an area occupied by the fine particles A2 is at least 70 area % with reference to a total of an area occupied by the fine particles A1 and the area occupied by the fine particles A2;

a content of the fine particles B in the toner is 0.1 mass % to 3.0 mass %; and when, of the fine particles B present at the surface of the toner particle, designating fine particles present embedded in the toner particle as a fine particles B1 and designating fine particles present not embedded in the toner particle as fine particles B2, in observation of cross sections of 100 particles of the toner using a transmission electron microscope (TEM), in the surface vicinity region from the location 30 nm inside from the surface of the toner particle to the outermost surface of the toner, a percentage for an area occupied by the fine particles B2 is not more than 50 area % with reference to a total of an area occupied by the fine particles B1 and the area occupied by the fine particles B2.

The present inventors also achieved a toner comprising:

a toner particle that contains a binder resin and a colorant, wherein fine particles A and fine particles B are present at a surface of the toner particle;

the fine particles A are organosilicon polymer particles containing an organosilicon polymer;

a content of the fine particles A in the toner is 0.5 mass % to 6.0 mass %;

the organosilicon polymer has a structure in which silicon atoms and oxygen atoms are alternately bonded to each other;

a portion of silicon atoms contained in the organosilicon polymer has a T3 unit structure as represented by the following formula (1)

$$R^1—SiO_{3/2} \quad (1)$$

where $R^1$ represents an alkyl group having 1 to 6 carbons or a phenyl group;

in a $^{29}$Si-NMR measurement using the organosilicon polymer particles, a proportion for an area of a peak originating with silicon having the T3 unit structure with reference to a total area of all Si element-originating peaks is 0.50 to 1.00;

the fine particles B contain at least one of titanium oxide and strontium titanate;

of the fine particles A present at the surface of the toner particle, designating fine particles present embedded in the toner particle as fine particles A1 and designating fine particles present not embedded in the toner particle as fine particles A2, a total coverage ratio of the toner by the fine particles A1 and the fine particles A2 is 10% to 70%;

in observation of cross sections of 100 particles of the toner using a transmission electron microscope (TEM), in a surface vicinity region from a location 30 nm inside from the surface of the toner particle to an outermost surface of the toner, a percentage for an area occupied by the fine particles A2 is at least 70 area % with reference to a total of an area occupied by the fine particles A1 and the area occupied by the fine particles A2;

a content of the fine particles B in the toner is 0.1 mass % to 3.0 mass %; and of the fine particles B present at the surface of the toner particle, designating fine particles present embedded in the toner particle as fine particles B1 and designating fine particles present not embedded in the toner particle as fine particles B2, in observation of cross sections of 100 particles of the toner using a transmission electron microscope (TEM), in the surface vicinity region from the location 30 nm inside from the surface of the toner particle to the outermost surface of the toner, a percentage for an area occupied by the fine particles B2 is not more than 50 area % with reference to a total of an area occupied by the fine particles B1 and the area occupied by the fine particles B2.

The volume resistivity of the fine particles B used in the first aspect of the present invention is $5.0\times10$ Ωm to $1.0\times10^8$ Ωm. A volume resistivity of less than $5.0\times10$ Ωm makes it difficult for the toner to maintain a suitable charge force and facilitates a decline in the image density. A volume resistivity above $1.0\times10^8$ Ωm impairs charge leakage when charge up has occurred and facilitates a decline in the transferability.

The volume resistivity of the fine particles B is preferably $1.0\times10^2$ Ωm to $5.0\times10^7$ Ωm and is more preferably $1.0\times10^4$ Ωm to $5.0\times10^7$ Ωm.

The fine particles B used in the first aspect of the present invention should have a volume resistivity of $5.0\times10$ Ωm to $1.0\times10^8$ Ωm, but are not otherwise particularly limited. A content of at least one selection from the group consisting of titanium oxide fine particles, strontium titanate fine particles, and alumina fine particles is preferred, while the fine particles B particularly preferably are titanium oxide fine particles, strontium titanate fine particles, or alumina fine particles. Composite oxide fine particles that use two or more metals may also be used, and a single type may be used by itself or two or more types selected in any combination from within these fine particle groups may be used.

The fine particles B used in the second aspect of the present invention are described in the following. The fine particles B used in the second aspect of the present invention contain at least one of titanium oxide fine particles and strontium titanate fine particles. Composite oxide fine particles that use two or more metals may also be used, and a single type may be used by itself or two or more types selected in any combination from within these fine particle groups may be used. The fine particles B are preferably titanium oxide fine particles or strontium titanate fine particles.

The fine particles B used in the second aspect of the present invention should contain at least one of titanium oxide fine particles and strontium titanate fine particles, but are not otherwise particularly limited. An additional inhibition of reductions in the image density and transferability can be obtained when the volume resistivity of the fine particles B is $5.0\times10$ Ωm to $1.0\times10^8$ Ωm, more preferably $1.0\times10^2$ Ωm to $5.0\times10^7$ Ωm, and still more preferably $1.0\times10^4$ Ωm to $5.0\times10^7$ Ωm.

It is crucial for maintaining a good transferability during the course of long-term use that the content of the fine particles B in the toner be 0.1 mass % to 3.0 mass %. A content of less than 0.1 mass % impairs charge leakage when charge up has occurred and facilitates a decline in the transferability, while a content above 3.0 mass % makes it difficult for the toner to maintain a suitable charge force and facilitates a decline in the image density.

The content of the fine particles B in the toner is preferably 0.3 mass % to 2.5 mass % and is more preferably 0.5 mass % to 2.5 mass %.

Of the fine particles B present at the toner particle surface, designating the fine particles present embedded in the toner particle as fine particles B1 and designating the fine particles present not embedded in the toner particle as fine particles B2, in observation of the cross sections of 100 particles of toner using a transmission electron microscope (also abbreviated below as "TEM"), in the surface vicinity region from the location 30 nm inside from the toner particle surface to the outermost surface of the toner, the percentage for the area occupied by fine particles B2 is not more than 50 area % with reference to the total of the area occupied by fine particles B1 and the area occupied by fine particles B2.

This thus indicates that a major fraction of the fine particles B is embedded in the toner particle and is present in the vicinity of the surface of the toner particle. When such a structure is present, charge leakage occurs even during long-term use and an optimal charge can be maintained, and as a consequence retention of the transferability is facilitated. The percentage for the area occupied by fine particles B2 is preferably not more than 35 area % and more preferably not more than 30 area %. The percentage for the area occupied by fine particles B2 is preferably equal to or greater than 0 area %.

When the percentage for the area occupied by the fine particles B2 exceeds 50 area %, fine particles B not embedded in the toner particle are present to a substantial degree. As a consequence, during long-term use the fine particles B can detach from the toner and the charge up-mediated attachment force can increase and the transferability can decline.

The percentage for the area occupied by the fine particles B2 can be controlled by changing the production conditions when the fine particles B are added to the toner particle, changing the glass transition temperature Tg (° C.) of the toner particle, and changing the number-average primary particle diameter of the fine particles B.

The number-average primary particle diameter of the fine particles B used by the present invention is 5 nm to 50 nm (more preferably 5 nm to 25 nm) based on a consideration of the function as a leakage site when charge up has occurred.

The content of the fine particles A in the toner is 0.5 mass % to 6.0 mass %. When the content is less than 0.5 mass %, the toner durability and the release effect for the toner are prone to be unsatisfactory and reductions in the transferability and image density with long-term use are facilitated. A content in excess of 6.0 mass % makes it difficult to obtain the charge leakage effect during charge up due to the fine particles B embedded in the toner particle and thus facilitates a decline in the transferability.

The content of the fine particles A in the toner is preferably 0.5 mass % to 5.0 mass % and is more preferably 0.5 mass % to 3.0 mass %.

Of the fine particles A present at the toner particle surface, designating the fine particles present embedded in the toner particle as fine particles A1 and designating the fine particles present not embedded in the toner particle as fine particles A2, in observation of the cross sections of 100 particles of toner using a TEM, in the surface vicinity region from the location 30 nm inside from the toner particle surface to the outermost surface of the toner, the percentage for the area occupied by fine particles A2 is at least 70 area % with reference to the total of the area occupied by fine particles A1 and the area occupied by fine particles A2.

This thus indicates that the major fraction of the fine particles A is not embedded in the toner particle. When such a structure is established, this is effective with regard to toner durability and releasability and maintenance of a good transferability during long-term use is facilitated. The percentage for the area occupied by the fine particles A2 is preferably at least 80 area % and is more preferably at least 90 area %. The percentage for the area occupied by the fine particles A2 is preferably equal to or less than 100 area %.

Maintenance of an excellent transferability during long-term use can be impeded when the percentage for the area occupied by the fine particles A2 is less than 70 area %.

The percentage for the area occupied by the fine particles A2 can be controlled by changing the production conditions when the fine particles A are added to the toner particle, changing the glass transition temperature Tg (° C.) of the toner particle, and changing the number-average primary particle diameter of the fine particles A.

The total coverage ratio by the fine particles A1 and the fine particles A2 at the toner particle surface is 10% to 70%. When the coverage ratio is less than 10%, the toner durability and release effect for the toner are prone to be unsatisfactory and reductions in the transferability and image density with long-term use are facilitated. A coverage ratio higher than 70% makes it difficult to obtain the charge leakage effect during charge up due to the fine particles B embedded in the toner particle and thus facilitates a decline in the transferability.

The coverage ratio is preferably 10% to 60% and is more preferably 10% to 50%. The coverage ratio can be controlled by changing the production conditions when the fine particles A are added to the toner particle and by changing the shape, number-average primary particle diameter, and amount of addition of the fine particles A.

The number-average primary particle diameter of the fine particles A used in the present invention is preferably 30 nm to 300 nm (more preferably 40 nm to 240 nm) from the standpoint of the durability of the toner during long-term use and reducing the attachment force of the toner.

The shape factor SF-1 of the fine particles A used in the present invention is preferably not more than 114 (more preferably not more than 110). When the shape factor SF-1 is not more than 114, the fine particles A are then closer to a spherical shape, and as a consequence the area of contact between the toner and the photosensitive drum can be minimized and the attachment force can be reduced and betterment of the transferability is facilitated.

The shape factor SF-1 is preferably at least 100. The shape factor SF-1 can be controlled by changing the conditions in the production of the fine particles A.

The dispersity evaluation index at the toner surface for the fine particles A used in the present invention is preferably 0.5 to 2.0 and is more preferably 0.5 to 1.8. The dispersity evaluation index at the toner surface for the fine particles B used in the present invention is preferably not more than 0.4 (more preferably not more than 0.3). The dispersity evaluation index at the toner surface for the fine particles B is preferably equal to or greater than 0.0.

A smaller numerical value for the dispersity evaluation index indicates a better dispersity. The maintenance of the charge on the toner at a favorable value during the course of long-term use is facilitated by having fine particles B reside in a uniform dispersion on the toner. With regard to the fine particles A, on the other hand, the presence of some degree of a density distribution is preferred. When regions exist on the toner surface where there are many of the fine particles A, the releasing effect of the organosilicon polymer particles is then exhibited to a substantial degree in the nip region between the photosensitive drum and the transfer roller, resulting in a reduction in the attachment force and facilitating an improved transferability.

The dispersity evaluation index for the fine particles A at the toner surface can be controlled by establishing external addition conditions that cause the elaboration of some degree of a density distribution on the toner. For example, by extending the external addition time under conditions in which mechanical impact forces are suppressed, rolling by the fine particles A on the toner surface is facilitated and the production of the desired density distribution is facilitated.

The dispersity evaluation index for the fine particles B at the toner surface can be controlled by establishing external addition conditions that improve the dispersity of the fine particles B. For example, by extending the external addition time under conditions in which mechanical impact forces are increased, the disintegration and dispersion of the fine particles B are facilitated and obtaining the desired dispersity evaluation index is facilitated.

Fine particles C may also be present at the toner particle surface, and the fine particles C are preferably silica fine particles having a number-average primary particle diameter of 5 nm to 50 nm (more preferably 5 nm to 30 nm). 5 nm to 50 nm silica fine particles readily undergo electrostatic aggregation and are difficult to disaggregate. However, when fine particles B are present at the toner particle surface layer, electrostatic aggregation of the silica fine particles is relaxed and the generation of an improved dispersity by the silica fine particles on the toner surface is facilitated. Due to this, through the external addition of the fine particles C, the generation of a uniform charge distribution on the toner surface is facilitated and additional improvements in the non-uniformity during transfer can be obtained. The uniformity of the image density is further enhanced as a result.

Of the fine particles C present at the toner particle surface, designating fine particles present embedded in the toner particle as fine particles C1 and fine particles present not embedded in the toner particle as fine particles C2, in observation of the cross sections of 100 particles of toner using a TEM, in the surface vicinity region from the location 30 nm inside from the toner particle surface to the outermost surface of the toner, the percentage for the area occupied by fine particles C2 is at least 70 area % (more preferably at least 72 area %) with reference to the total of the area occupied by fine particles C1 and the area occupied by fine particles C2.

This thus indicates that the major fraction of the fine particles C is not embedded in the toner particle. As a consequence, the fine particles B and fine particles C of the toner particle surface layer interact with each other and the dispersity of the silica fine particles at the toner surface is improved and the uniformity of the image density is further improved. The percentage for the area occupied by the fine particles C2 is preferably equal to or less than 100 area %. The percentage for the area occupied by the fine particles C2 can be controlled by changing the production conditions when the fine particles C are added to the toner particle, changing the glass transition temperature Tg (° C.) of the toner particle, and changing the number-average primary particle diameter of the fine particles C.

The organosilicon polymer particles used in the present invention are described in the following. The organosilicon polymer particles refer to resin particles constituted of a main chain in which between silicon atom bearing an organic group and oxygen atom are alternately bonded to each other.

There is no particular limitation on the method for producing the organosilicon polymer particles used in the present invention, and, for example, these organosilicon polymer particles can be obtained by the dropwise addition of a silane compound to water and execution of hydrolysis and condensation reactions under catalysis, followed by filtration of the resulting suspension and drying. The number-average primary particle diameter of the organosilicon polymer particles can be controlled using, for example, the type of catalyst, the blending ratio, the temperature at the start of the reaction, and the duration of dropwise addition.

Acidic catalysts for use as the catalyst can be exemplified by hydrochloric acid, hydrofluoric acid, sulfuric acid, and nitric acid, and basic catalysts for use as the catalyst can be exemplified by aqueous ammonia, sodium hydroxide, and potassium hydroxide, but there is no limitation to these.

The organosilicon polymer particles used in the present invention contain an organosilicon polymer, and the organosilicon polymer has a structure in which silicon atoms and oxygen atoms are alternately bonded to each other, and a portion of silicon atoms in the organosilicon polymer has a T3 unit structure as represented by the formula (1) given below.

$$R^1—SiO_{3/2} \quad (1)$$

Where $R^1$ represents an alkyl group having 1 to 6 (preferably 1 to 4) carbons or a phenyl group.

The organosilicon polymer particles preferably contain an organosilicon polymer of at least 90 mass % based on the organosilicon polymer particles. The organosilicon polymer particles preferably contain an organosilicon polymer of 100 mass % or less based on the organosilicon polymer particles.

In $^{29}$Si-NMR measurement using the organosilicon polymer particles, the proportion for the area of the peak originating with silicon having the T3 unit structure with reference to the total area of all Si element-originating peaks is 0.50 to 1.00. As a consequence, the organosilicon polymer particle can be provided with a favorable elasticity, and the effects of the present invention are obtained due to this. A proportion for the area of the peak originating with silicon having the T3 unit structure of less than 0.50 is disadvantageous because the elasticity of the organosilicon polymer particles then readily becomes unsatisfactory.

The proportion for the area of the peak originating with silicon having the T3 unit structure is preferably 0.70 to 1.00 and is more preferably 0.80 to 1.00. The proportion for the area of the peak originating with silicon having the T3 unit structure can be controlled by changing the organosilicon compound used in the polymerization that yields the organosilicon polymer particles and in particular by changing the type and/or proportion of trifunctional silane.

The organosilicon polymer particles used in the present invention are preferably obtained by polymerizing an organosilicon compound having the structure represented by the following formula (2).

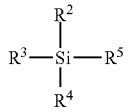

(2)

Where $R^2$, $R^3$, $R^4$, and $R^5$ each independently represent an alkyl group having 1 to 6 (more preferably 1 to 4) carbons, a phenyl group, or a reactive group (for example, a halogen atom, hydroxy group, acetoxy group, or alkoxy group).

An organosilicon compound having four reactive groups in each formula (2) molecule (tetrafunctional silane), an organosilicon compound having in formula (2) an alkyl group or phenyl group for $R^2$ and three reactive groups ($R^3$, $R^4$, $R^5$) (trifunctional silane), an organosilicon compound having in formula (2) an alkyl group or phenyl group for $R^2$ and $R^3$ and two reactive groups ($R^4$, $R^5$) (difunctional silane), and an organosilicon compound having in formula (2) an alkyl group or phenyl group for $R^2$, $R^3$, and $R^4$ and one reactive group ($R^5$) (monofunctional silane) can be used to obtain the organosilicon polymer particles used in the present invention, and the use of at least 50 mol % trifunctional silane for the organosilicon compound is preferred in order to obtain 0.50 to 1.00 for the proportion for the area of the peak originating with the T3 unit structure.

The organosilicon polymer particle can be obtained by causing the reactive groups to undergo hydrolysis, addition polymerization, and condensation polymerization to form a crosslinked structure. The hydrolysis, addition polymerization, and condensation polymerization of $R^3$, $R^4$, and $R^5$ can be controlled using the reaction temperature, reaction time, reaction solvent, and pH.

The tetrafunctional silane can be exemplified by tetramethoxysilane, tetraethoxysilane, and tetraisocyanatosilane.

The trifunctional silane can be exemplified by methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, methyldiethoxyhydroxysilane, ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, hexyltrihydroxysilane, phenyltrimethoxysilane, phenyltriethoxysilane, phenyltrichlorosilane, phenyltriacetoxysilane, phenyltrihydroxysilane, and pentyltrimethoxysilane.

The difunctional silane can be exemplified by di-tert-butyldichlorosilane, di-tert-butyldimethoxysilane, di-tert-butyldiethoxysilane, dibutyldichlorosilane, dibutyldimethoxysilane, dibutyldiethoxysilane, dichlorodecylmethylsilane, dimethoxydecylmethylsilane, diethoxydecylmethylsilane, dichlorodimethylsilane, dimethyldimethoxysilane, diethoxydimethylsilane, and diethyldimethoxysilane.

The monofunctional silane can be exemplified by t-butyldimethyl chlorosilane, t-butyldimethylmethoxysilane, t-butyldimethyl ethoxysilane, t-butyldiphenylchlorosilane, t-butyldiphenylmethoxysilane, t-butyldiphenylethoxysilane, chlorodimethylphenylsilane, methoxydimethylphenylsilane, ethoxydimethylphenylsilane, chlorotrimethylsilane, trimethylmethoxysilane, ethoxytrimethylsilane, triethylmethoxysilane, triethylethoxysilane, tripropylmethoxysilane, tributylmethoxysilane, tripentylmethoxysilane, triphenylchlorosilane, triphenylmethoxysilane, and triphenylethoxysilane.

A surface treatment may be carried out on the fine particles B used in the present invention with the goal of imparting hydrophobicity.

The hydrophobic treatment agent can be exemplified by chlorosilanes, e.g., methyltrichlorosilane, dimethyldichlorosilane, trimethylchlorosilane, phenyltrichlorosilane, diphenyldichlorosilane, t-butyldimethylchlorosilane, and vinyltrichlorosilane;

alkoxysilanes, e.g., isobutyltrimethoxysilane, tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, isobutyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, isobutyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl) aminopropyltrimethoxysilane, and γ-(2-aminoethyl)aminopropylmethyldimethoxysilane;

silazanes, e.g., hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane;

silicone oils, e.g., dimethylsilicone oil, methylhydrogensilicone oil, methylphenylsilicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, and terminal-reactive silicone oil;

siloxanes, e.g., hexamethylcyclotrisiloxane, octamethylcyclotetrasiloxane, decamethylcyclopentasiloxane, hexamethyldisiloxane, and octamethyltrisiloxane; and fatty acids and their metal salts, e.g., long-chain fatty acids such as undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid, and arachidonic acid, as well as salts of these fatty acids with metals such as zinc, iron, magnesium, aluminum, calcium, sodium, and potassium.

The use is preferred among the preceding of alkoxysilanes, silazanes, and silicone oils because they support facile execution of the hydrophobic treatment. A single one of these hydrophobic treatment agents may be used by itself or two or more may be used in combination.

The fine particles C used in the present invention are described in the following. The fine particles C used in the present invention are silica fine particles, and use may be made of silica fine particles obtained by a dry method, such as fumed silica, or silica fine particles obtained by a wet method such as the sol-gel method. The use of silica fine particles obtained by a dry method is preferred from the standpoint of the charging performance.

The fine particles C may be subjected to a surface treatment with the goal of imparting hydrophobicity and flowability. With regard to the hydrophobing method, hydrophobicity is imparted by a chemical treatment with an organosilicon compound that reacts with or physically adsorbs to the silica fine particle. In a preferred method, a silica produced by the vapor-phase oxidation of a silicon halide compound is treated with an organosilicon compound. This organosilicon compound can be exemplified by the following:

hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, and benzyldimethylchlorosilane.

Additional examples are bromomethyldimethylchlorosilane, α-chloroethyltrichlorosilane, β-chloroethyltrichlorosilane, chloromethyldimethylchlorosilane, triorganosilylmercaptan, trimethylsilylmercaptan, and triorganosilyl acrylate.

Still more examples are vinyldimethylacetoxysilane, dimethylethoxysilane, dimethyldimethoxysilane, diphenyldiethoxysilane, and 1-hexamethyldisiloxane.

Other examples are 1,3-divinyltetramethylsiloxane, 1,3-diphenyltetramethyldisiloxane, and dimethylpolysiloxanes having 2 to 12 siloxane units in each molecule and containing a hydroxyl group bonded to the Si in each of the units disposed in terminal position. One of these or a mixture of two or more is used.

A silicone oil-treated silica may also be used as the fine particles C. A silicone oil having a viscosity at 25° C. of 30 $mm^2/s$ to 1,000 $mm^2/s$ is preferably used as the silicone oil.

Specific examples are dimethylsilicone oils, methylphenylsilicone oils, α-methylstyrene-modified silicone oils, chlorophenyl silicone oils, and fluorine-modified silicone oils.

The following methods are examples of methods for carrying out treatment with the silicone oil:

methods in which the silicone oil is sprayed on the silica that serves as a base, and methods in which the silicone oil is dissolved or dispersed in a suitable solvent followed by addition of the silica with mixing and then removal of the solvent.

The silicone oil-treated silica is more preferably subjected to a stabilization of the coating on the surface by heating the silica, after the silicone oil treatment, to a temperature of at least 200° C. (more preferably at least 250° C.) in an inert gas.

The toner according to the present invention may contain additional external additives in order to improve the properties of the toner.

A preferred production method for the addition of the fine particles A, the fine particles B, and the fine particles C is described in the following.

The step of adding the fine particles B and the fine particles A is preferably divided into two stages in order to elaborate a structure in which the fine particles B are embedded in the toner particle surface layer while embedding of the fine particles A is suppressed. The step of adding the fine particles B and the fine particles A to the toner particle may use addition by a dry method or addition by a wet method, and a different method may be used in each of the two stages. Production using a two-stage external addition step is in particular more preferred from the standpoint of the ability to control the state of occurrence of the fine particles B and the fine particles A.

In order to embed the fine particles B in the toner particle surface layer, the fine particles B preferably are embedded through the application of heat by heating the external addition apparatus in the external addition step (step of mixing the fine particles B with the toner particle). The fine particles B can be embedded by the application of a mechanical impact force to the toner surface layer that has been slightly softened by the application of heat. Moreover, production may also be carried out by a method in which the fine particles B are mixed with the toner particle in an external addition step and the fine particles B are subsequently embedded by the disposition of a heating step in a separate apparatus.

In order to achieve the desired embedding of the fine particles B, the temperature in the external addition step is preferably set to the vicinity of the glass transition temperature Tg of the toner particle.

Specifically, the temperature $T_B$ (° C.) in the external addition step for the fine particles B is preferably the condition Tg−10 (° C.)≤$T_B$≤Tg+5 (° C.) and is more preferably the condition Tg−10 (° C.)≤$T_B$≤Tg where Tg (° C.) is the glass transition temperature of the toner particle.

Viewed from the standpoint of the storability, the glass transition temperature Tg of the toner particle is preferably 40° C. to 70° C. and is more preferably 50° C. to 65° C.

The apparatus used in the external addition step for the fine particles B is preferably an apparatus that has a mixing capability as well as the ability to apply a mechanical impact force, and known mixing processing devices can be used. For example, the fine particles B can be embedded in the toner particle by heating and using a known mixer, e.g., an FM mixer (Nippon Coke & Engineering Co., Ltd.), Super Mixer (Kawata Mfg. Co., Ltd.), and Hybridizer (Nara Machinery Co., Ltd.).

A preferred method for adding the fine particles A to the toner particle in which the fine particles B are already embedded is described in the following. The same apparatus as used in the external addition step for fine particles B can be used in order to achieve a structure in which the major fraction of the fine particles A is not embedded in the toner particle. The use of a heated mixer is not required in the case of the external addition of the fine particles A, and the condition for the temperature $T_A$ (° C.) of the external addition step for the fine particles A is preferably $T_A$≤Tg−15 (° C.) and more preferably Tg−40 (° C.) $T_A$≤Tg−25 (° C.) with reference to the glass transition temperature Tg (° C.) of the toner particle.

A preferred method for adding the fine particles C to the toner particle in which the fine particles B are already embedded is described in the following. The fine particles C are preferably added by a dry external addition step, and the same apparatus as used in the external addition step for fine particles B can be used. The use of a heated mixer is not required in the case of the external addition of the fine particles C, and the condition for the temperature $T_C$ (° C.) of the external addition step for the fine particles C is preferably $T_C$≤Tg−15 (° C.) and more preferably Tg−40 (° C.)≤$T_C$≤Tg−25 (° C.) with reference to the glass transition temperature Tg (° C.) of the toner particle.

With regard to the timing for the addition of the fine particles C, the fine particles A and fine particles C may be externally added at the same time to the toner particle in which the fine particles B are already embedded, or the fine particles C may be externally added after the fine particles A have been added to the toner particle in which the fine particles B are already embedded.

The method for producing the toner particle is described in the following. A known means can be used for the method for producing the toner particle, and a kneading pulverization method or wet production method can be used. The use of a wet production method is preferred from the standpoints of providing a uniform particle diameter and the ability to control the shape. Wet production methods can be exemplified by the suspension polymerization method, dissolution suspension method, emulsion polymerization aggregation method, and emulsion aggregation method, with the use of the emulsion aggregation method being preferred.

In the emulsion aggregation method, materials such as colorant and binder resin fine particles are first dispersed and mixed in an aqueous medium. A dispersion stabilizer and/or surfactant may be added to the aqueous medium. This is followed by the addition of an aggregating agent to induce aggregation until the desired toner particle diameter is reached, and melt adhesion between the resin fine particles is carried out at the same time as or after aggregation. This is a method in which the toner particle is formed by optionally controlling the shape by heating. Here, the binder resin fine particles may also be composite particles formed by a plurality of layers constituted of two or more layers composed of resins having different compositions. For example, production may be carried out by, for example, an emulsion polymerization method, a mini-emulsion polymerization method, or a phase inversion emulsification method, or production may be carried out by a combination of several production methods.

When an internal additive is incorporated in the toner particle, the internal additive may be contained in the resin fine particles, or a separate dispersion of internal additive fine particles composed of only the internal additive may be prepared and these internal additive fine particles may be aggregated in combination with aggregation of the resin fine particles. In addition, a toner particle constituted of layers having different compositions may also be produced by carrying out aggregation with the addition at different times during aggregation of resin fine particles having different compositions.

The following can be used as the dispersion stabilizer. Inorganic dispersion stabilizers can be exemplified by tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Organic dispersion stabilizers can be exemplified by polyvinyl alcohol, gelatin, methyl cellulose, methyl hydroxypropyl cellulose, ethyl cellulose, the sodium salt of carboxymethyl cellulose, and starch.

A known cationic surfactant, anionic surfactant, or nonionic surfactant can be used as the surfactant. The cationic surfactants can be specifically exemplified by dodecylammonium bromide, dodecyltrimethylammonium bromide, dodecylpyridinium chloride, dodecylpyridinium bromide, and hexadecyltrimethylammonium chloride. The nonionic surfactants can be specifically exemplified by dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, and monodecanoyl sucrose. The anionic surfactants can be specifically exemplified by aliphatic soaps such as sodium stearate and sodium laurate, as well as by sodium lauryl sulfate, sodium dodecylbenzenesulfonate, and sodium polyoxyethylene(2) lauryl ether sulfate.

The binder resin that constitutes the toner particle is described in the following.

Vinyl resins and polyester resins are preferred examples of the binder resin. The following resins and polymers are examples of the vinyl resins and polyester resins as well as other binder resins:

homopolymers of styrene or a substituted form thereof, e.g., polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; as well as polymethyl methacrylate, polybutyl methacrylate, polyvinyl acetate, polyethylene, polypropylene, polyvinyl butyral, silicone resins, polyamide resins, epoxy resins, polyacrylic resins, rosin, modified rosin, terpene resins, phenolic resins, aliphatic hydrocarbon resins, alicyclic hydrocarbon resins, and aromatic petroleum resins. A single one of these binder resins may be used by itself or a mixture of two or more may be used.

The binder resin preferably contains a carboxy group, and is preferably a resin produced using a carboxy group-containing polymerizable monomer. Examples here are vinyl carboxylic acids such as acrylic acid, methacrylic acid, α-ethylacrylic acid, and crotonic acid; unsaturated dicarboxylic acids such as fumaric acid, maleic acid, citraconic acid, and itaconic acid; and the monoester derivatives of unsaturated dicarboxylic acids, such as the monoacryloyloxyethyl ester of succinic acid, monomethacryloyloxyethyl ester of succinic acid, monoacryloyloxyethyl ester of phthalic acid, and monomethacryloyloxyethyl ester of phthalic acid.

Polyester resins provided by the condensation polymerization of a carboxylic acid component and an alcohol component as exemplified in the following can be used as the polyester resin. The carboxylic acid component can be exemplified by terephthalic acid, isophthalic acid, phthalic acid, fumaric acid, maleic acid, cyclohexanedicarboxylic acid, and trimellitic acid. The alcohol component can be exemplified by bisphenol A, hydrogenated bisphenol A, ethylene oxide adducts on bisphenol A, propylene oxide adducts on bisphenol A, glycerol, trimethylolpropane, and pentaerythritol.

The polyester resin may be a urea group-containing polyester resin. The polyester resin is preferably polyester resin in which the carboxylic acid, e.g., in terminal position, is not capped.

A crosslinking agent may be added to the polymerization of the polymerizable monomer in order to control the molecular weight of the binder resin that constitutes the toner particle.

Examples here are ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, the diacrylates of polyethylene glycol #200, #400, and #600, dipropylene glycol diacrylate, polypropylene glycol diacrylate, polyester-type diacrylates (MANDA, Nippon Kayaku Co., Ltd.), and crosslinking agents provided by changing the acrylate in the preceding to methacrylate.

The amount of addition of the crosslinking agent preferably is 0.001 mass % to 15.000 mass % with reference to the polymerizable monomer.

A release agent is preferably incorporated as one of the materials that constitute the toner particle. When, in particular, an ester wax having a melting point from 60° C. to 90° C. (more preferably 60° C. to 80° C.) is used as the release agent, the appearance of a plasticizing effect is facilitated due to the excellent compatibility with the binder resin and the fine particles B can then be efficiently embedded in the toner particle surface.

The ester wax used by the present invention can be exemplified by waxes in which the main component is a fatty acid ester, e.g., carnauba wax and montanic acid ester wax; ester waxes provided by the partial or complete deacidification of the acid component from a fatty acid ester, e.g., deacidified carnauba wax; hydroxyl group-bearing methyl ester compounds as obtained, for example, by the hydrogenation of plant oils and fats; saturated fatty acid monoesters, e.g., stearyl stearate and behenyl behenate; diesters between a saturated aliphatic dicarboxylic acid and a saturated aliphatic alcohol, e.g., dibehenyl sebacate, distearyl dodecanedioate, and distearyl octadecanedioate; and diesters between a saturated aliphatic diol and a saturated aliphatic monocarboxylic acid, e.g., nonanediol dibehenate and dodecanediol distearate.

Among these waxes, a content of a difunctional ester wax (diester), which has two ester bonds in the molecular structure, is preferred.

A difunctional ester wax is an ester compound between a dihydric alcohol and an aliphatic monocarboxylic acid or an ester compound between a dibasic carboxylic acid and an aliphatic monoalcohol.

The aliphatic monocarboxylic acid can be exemplified by myristic acid, palmitic acid, stearic acid, arachidic acid, behenic acid, lignoceric acid, cerotic acid, montanic acid, melissic acid, oleic acid, vaccenic acid, linoleic acid, and linolenic acid.

The aliphatic monoalcohol can be specifically exemplified by myristyl alcohol, cetanol, stearyl alcohol, arachidyl alcohol, behenyl alcohol, tetracosanol, hexacosanol, octacosanol, and triacontanol.

The dibasic carboxylic acid can be specifically exemplified by butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecanedioic acid, tetradecanedioic acid, hexadecanedioic acid, octadecanedioic acid, eicosanedioic acid, phthalic acid, isophthalic acid, and terephthalic acid.

The dihydric alcohol can be specifically exemplified by ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexanedimethanol, spiroglycol, 1,4-phenylene glycol, bisphenol A, and hydrogenated bisphenol A.

Examples of other usable release agents are petroleum-based waxes such as paraffin waxes, microcrystalline waxes, and petrolatum, and derivatives thereof; montan wax and derivatives thereof; hydrocarbon waxes produced by the Fischer-Tropsch method, and derivatives thereof; polyolefin waxes such as polyethylene and polypropylene, and derivatives thereof; natural waxes such as carnauba wax and candelilla wax, and derivatives thereof; higher aliphatic alcohols; and fatty acids such as stearic acid and palmitic acid, and compounds thereof. The content of the release agent is preferably 5.0 mass parts to 20.0 mass parts per 100.0 mass parts of the binder resin or polymerizable monomer.

The known colorants indicated in the following can be used when a colorant is incorporated in the toner particle; however, there is no limitation to these.

Yellow iron oxide, Naples Yellow, Naphthol Yellow S, Hansa Yellow G, Hansa Yellow 10G, Benzidine Yellow G, Benzidine Yellow GR, quinoline yellow lake, condensed azo compounds such as Permanent Yellow NCG and tartrazine lake, isoindolinone compounds, anthraquinone compounds, azo metal complexes, methine compounds, and allylamide compounds are used as yellow pigments. The following are specific examples:

C. I. Pigment Yellow 12, 13, 14, 15, 17, 62, 74, 83, 93, 94, 95, 109, 110, 111, 128, 129, 147, 155, 168, and 180.

Red iron oxide; condensed azo compounds such as Permanent Red 4R, Lithol Red, Pyrazolone Red, Watching Red calcium salt, Lake Red C, Lake Red D, Brilliant Carmine 6B, Brilliant Carmine 3B, eosin lake, Rhodamine Lake B, and Alizarin Lake; diketopyrrolopyrrole compounds; anthraquinone; quinacridone compounds; basic dye lake compounds; naphthol compounds; benzimidazolone compounds; thioindigo compounds; and perylene compounds are examples of red pigments. The following are specific examples:

C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Blue pigments can be exemplified by alkali blue lake; Victoria Blue Lake; copper phthalocyanine compounds and derivatives thereof, e.g., Phthalocyanine Blue, metal-free Phthalocyanine Blue, partially chlorinated Phthalocyanine Blue, Fast Sky Blue, and Indathrene BG; anthraquinone compounds; and basic dye lake compounds. Specific examples are as follows:

C. I. Pigment Blue 1, 7, 15, 15:1, 15:2, 15:3, 15:4, 60, 62, and 66.

The black pigments can be exemplified by carbon black and aniline black. A single one or a mixture of these colorants can be used, and these colorants may also be used in the form of solid solutions.

The colorant content is preferably 3.0 mass parts to 15.0 mass parts per 100.0 mass parts of the binder resin or polymerizable monomer.

The toner particle may contain a charge control agent. A known charge control agent may be used as this charge control agent. Charge control agents that provide a fast charging speed and are able to stably maintain a certain charge quantity are particularly preferred.

Charge control agents that control the toner particle to negative charging can be exemplified by the following:

as organometal compounds and chelate compounds, monoazo metal compounds, acetylacetone-metal compounds, and metal compounds of aromatic oxycarboxylic acids, aromatic dicarboxylic acids, oxycarboxylic acids, and dicarboxylic acids. The following, for example, may also be incorporated: aromatic oxycarboxylic acids, aromatic monocarboxylic acids, and aromatic polycarboxylic acids and their metal salts, anhydrides, and esters, as well as phenol derivatives such as bisphenol. Additional examples are urea derivatives, metal-containing salicylic acid compounds, metal-containing naphthoic acid compounds, boron compounds, quaternary ammonium salts, and calixarene.

Charge control agents that control the toner particle to positive charging, on the other hand, can be exemplified by the following: nigrosine and nigrosine modifications by, e.g., fatty acid metal salts; guanidine compounds; imidazole compounds; quaternary ammonium salts such as tributylbenzylammonium 1-hydroxy-4-naphthosulfonate and tetrabutylammonium tetrafluoroborate, and their onium salt analogues, such as phosphonium salts, and their lake pigments; triphenylmethane dyes and their lake pigments (the laking agent is exemplified by phosphotungstic acid, phosphomolybdic acid, phosphomolybdotungstic acid, tannic acid, lauric acid, gallic acid, ferricyanides, and ferrocyanides); metal salts of higher fatty acids; and charge control resins.

A single one of these charge control agents can be incorporated by itself or a combination of two or more can be incorporated. The amount of addition of these charge control agents is preferably 0.01 mass parts to 10.00 mass parts per 100.00 mass parts of the polymerizable monomer.

The methods used to measure the various properties of the toner according to the present invention are described in the following. Identification of Organosilicon Polymer Particles (Fine Particles A)

The composition and ratios for the constituent compounds of the organosilicon polymer particles contained in the toner are identified using pyrolysis gas chromatography-mass analysis (also abbreviated in the following as "pyrolysis GC/MS") and NMR. When the organosilicon polymer particles can be independently acquired as such, measurement can also be carried out on these organosilicon polymer particles as such.

Pyrolysis GC/MS is used for analysis of the species of constituent compounds of the organosilicon polymer particles.

The species of constituent compounds of the organosilicon polymer particles are identified by analysis of the mass spectrum of the pyrolyzate components derived from the organosilicon polymer particles and produced by pyrolysis of the toner at 550° C. to 700° C. The specific measurement conditions are as follows.

Measurement Conditions for Pyrolysis GC/MS
pyrolysis instrument: JPS-700 (Japan Analytical Industry Co., Ltd.)
pyrolysis temperature: 590° C.
GC/MS instrument: Focus GC/ISQ (Thermo Fisher)
column: HP-5MS, 60 m length, 0.25 mm inner diameter, 0.25 μm film thickness injection port temperature: 200° C.
flow pressure: 100 kPa
split: 50 mL/min
MS ionization: EI
ion source temperature: 200° C., 45 to 650 mass range The abundance of the identified constituent compounds of the organosilicon polymer particles is then measured and calculated using solid-state $^{29}$Si-NMR.

In solid-state $^{29}$Si-NMR, peaks are detected in different shift regions depending on the structure of the functional groups bonded to the Si in the constituent compounds of the organosilicon polymer particles.

The structures binding to Si can be specified by using standard samples to specify each peak position. The abundance of each constituent compound is calculated from the obtained peak areas. The determination is carried out by calculating the proportion for the peak area for the T3 unit structure with respect to the total peak areas.

The measurement conditions for the solid-state $^{29}$Si-NMR are as follows.

instrument: JNM-ECX5002 (JEOL RESONANCE)
temperature: room temperature measurement method: DDMAS method, 29Si, 45°
sample tube: zirconia 3.2 mmφ
sample: powder filled into test tube
sample rotation rate: 10 kHz
relaxation delay: 180 s
scans: 2,000

When the toner contains silicon-containing material other than the organosilicon polymer particles, the toner is dispersed in a solvent such as chloroform and the silicon-containing material other than the organosilicon polymer particles is then removed, for example, by centrifugal separation, based on the difference in specific gravity. This method is as follows.

1 g of the toner is first added to and dispersed in 31 g of chloroform in a vial and the silicon-containing material other than the organosilicon polymer particles is separated from the toner. To effect dispersion, a dispersion is prepared by treatment for 30 minutes using an ultrasound homogenizer. The treatment conditions are as follows.

ultrasound treatment instrument: VP-050 ultrasound homogenizer (TIETECH Co., Ltd.)
microchip: stepped microchip, 2 mmφ end diameter
position of microchip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. The following are separated in the glass tube after centrifugal separation: the silicon-containing material other than the organosilicon polymer particles, and a sediment provided by the removal from the toner of the silicon-containing material other than the organosilicon polymer particles. The sediment provided by the removal from the toner of the silicon-containing material other than the organosilicon polymer particles is withdrawn and is dried under vacuum conditions (40° C./24 hours) to obtain a sample provided by the removal from the toner of the silicon-containing material other than the organosilicon polymer particles. The composition and ratios for the constituent compounds of the organosilicon polymer particles contained in the toner can then be determined using the same procedure as described above.

Method for Quantitating Organosilicon Polymer Particles Contained in Toner

The content of the organosilicon polymer particles contained in the toner is measured using x-ray fluorescence.

The x-ray fluorescence measurement is based on JIS K 0119-1969, and specifically is carried out as follows. An "Axios" wavelength-dispersive x-ray fluorescence analyzer (PANalytical B.V.) is used as the measurement instrument, and the "SuperQ ver. 5.0L" (PANalytical B.V.) software provided with the instrument is used in order to set the measurement conditions and analyze the measurement data. Rh is used for the x-ray tube anode; a vacuum is used for the measurement atmosphere; and the measurement diameter (collimator mask diameter) is 27 mm. With regard to the measurement, measurement is carried out using the Omnian method in the element range from F to U, and detection is carried out with a proportional counter (PC) in the case of measurement of the light elements and with a scintillation counter (SC) in the case of measurement of the heavy elements. The acceleration voltage and current value for the x-ray generator are established so as to provide an output of 2.4 kW. For the measurement sample, 4 g of the toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm and a diameter of 39 mm by compression for 60 seconds at 20 MPa, and this pellet is used as the measurement sample.

X-ray exposure is carried out on the pellet molded under the aforementioned conditions, and the resulting characteristic x-rays (fluorescent x-rays) are dispersed with a dispersion element. The intensity of the fluorescent x-rays dispersed at the angle corresponding to the wavelength specific to each element contained in the sample is analyzed by the fundamental parameter method (FP method), the content ratio for each element contained in the toner is obtained as a result of the analysis, and the silicon atom content in the toner is determined.

The content of the organosilicon polymer particles in the toner can be obtained by calculation from the relationship between the silicon content in the toner that is determined by x-ray fluorescence and the content ratio for the silicon in the constituent compounds of the organosilicon polymer particles for which the structure has been established using, e.g., solid-state $^{29}$Si-NMR and pyrolysis GC/MS.

When a silicon-containing material other than the organosilicon polymer particles is contained in the toner, using the same methods as described above, a sample provided by the removal from the toner of the silicon-containing material other than the organosilicon polymer particles, can be obtained and the organosilicon polymer particles contained in the toner can be quantitated.

Method for Measuring Presence/Absence of T3 Unit Structure in Organosilicon Polymer Particles and Proportion for Area of Peak Originating with Silicon Having T3 Unit Structure The results for the solid-state $^{29}$Si-NMR measured in "Identification of the Organosilicon Polymer Particles (Fine Particles A)" are used for the presence/absence of the T3 unit structure in the organosilicon polymer particles and the proportion for the area of the peak originating with silicon having the T3 unit structure. In solid-state $^{29}$Si-NMR, peaks are detected in different shift regions depending on the structure of the functional groups bonded to the Si in the constituent compounds of the organosilicon polymer particles. The proportion for the T3 unit structure is taken to be the proportion for the peak area assigned to the T3 structure with reference to the total area for all peaks.

Method for Measuring Number-average Primary Particle Diameter of Fine Particles A Measurement of the number-average primary particle diameter of the fine particles A is performed using an "S-4800" scanning electron microscope (product name, Hitachi, Ltd.). Observation is carried out on the toner to which fine particles A have been added; in a visual field enlarged by a maximum of 50,000×, the long diameter of the primary particles of 100 randomly selected fine particles A is measured; and the number-average particle diameter is determined. The enlargement factor in the observation is adjusted as appropriate depending on the size of the fine particles A.

When the fine particles A can be independently acquired as such, measurement can also be performed on these fine particles A as such.

When the toner contains silicon-containing material other than the organosilicon polymer particles, EDS analysis is carried out on the individual particles of the external additive during observation of the toner and the determination is made, based on the presence/absence of a peak for the element Si, as to whether the analyzed particles are organosilicon polymer particles.

When the toner contains both organosilicon polymer particles and silica fine particles, the organosilicon polymer particles are identified by comparing the ratio (Si/O ratio) for the Si and O element contents (atomic %) with a standard. EDS analysis is carried out under the same conditions on standards for both the organosilicon polymer particles and silica fine particles to obtain the element content (atomic %) for both the Si and O. Using A for the Si/O ratio for the organosilicon polymer particles and B for the Si/O ratio for the silica fine particles, measurement conditions are selected whereby A is significantly larger than B. Specifically, the measurement is run ten times under the same conditions on the standards and the arithmetic mean value is obtained for both A and B. Measurement conditions are selected whereby the obtained average values satisfy AB>1.1.

When the Si/O ratio for a fine particle to be classified is on the A side from [(A+B)/2], the fine particle is then scored as an organosilicon polymer particle.

Tospearl 120A (Momentive Performance Materials Japan LLC) is used as the standard for the organosilicon polymer particles, and HDK V15 (Asahi Kasei Corporation) is used as the standard for the silica fine particles.

Method for Measuring Shape Factor SF-1 of Fine Particles A

The shape factor SF-1 of the fine particles A is measured using an "5-4800" scanning electron microscope (product name, Hitachi, Ltd.). Observation is performed on the toner to which the fine particles A have been added, and calculation is carried out as follows. The enlargement factor in the observation is adjusted as appropriate depending on the size of the fine particles A. In a visual field enlarged by a maximum of 200,000×, the area and peripheral length of the primary particles of 100 randomly selected fine particles A is calculated using "Image-Pro Plus 5.1J" (Media Cybernetics, Inc.) image processing software. SF-1 is calculated using the following formula, and its average value is taken to be SF-1.

$$\text{SF-1}=(\text{largest length of the particle})/\text{particle area}\times\pi/4\times100$$

When the fine particles A can be independently acquired as such, the measurement may also be performed on these fine particles A as such.

When the toner contains a silicon-containing material other than the organosilicon polymer particles, classification as an organosilicon polymer particle is performed by the method described in "Method for Measuring the Number-Average Primary Particle Diameter of the Fine Particles A" and SF-1 is then calculated for the organosilicon polymer particles.

Method for Measuring Volume Resistivity of Fine Particles B

The volume resistivity of the fine particles B is calculated from the current value measured using an electrometer (Keithley Model 6430 Sub-Femtoamp Remote SourceMeter). 1.0 g of the fine particles B is filled into a sample holder having upper and lower sandwiching electrodes (Model SH2-Z from Toyo Corporation), and the fine particles B are compressed by the application of a torque of 2.0 N·m. An upper electrode with a diameter of 25 mm and a lower electrode with a diameter of 2.5 mm are used for the electrodes. A voltage of 10.0 V is applied to the external additive through the sample holder; the resistance value is determined from the current value at the time of saturation not including the charging current; and the volume resistivity is calculated using the formula given below.

With regard to the method for isolating the fine particles B from the toner, the toner is dispersed in a solvent, e.g., chloroform, and the fine particles B can be isolated using the difference in specific gravity by, e.g., centrifugal separation. When the fine particles B can be independently acquired as such, the measurement may also be carried out on these fine particles B as such.

$$\text{volume resistivity } (\Omega\text{m})=\text{resistance value } (\Omega)\cdot\text{electrode area } (\text{m}^2)/\text{sample thickness } (\text{m})$$

Method for Measuring Number-average Primary Particle Diameter of Fine Particles B Measurement of the number-average primary particle diameter of the fine particles B is performed using an "S-4800" scanning electron microscope (product name, Hitachi, Ltd.). Observation is carried out on the toner to which fine particles B have been added; in a visual field enlarged by a maximum of 50,000×, the long diameter of the primary particles of 100 randomly selected fine particles B is measured; and the number-average particle diameter is determined. The enlargement factor in the observation is adjusted as appropriate depending on the size of the fine particles B.

When the fine particles B can be independently acquired as such, measurement can also be performed on these fine particles B as such.

When fine particles other than fine particles A and fine particles B are present in observation of toner according to the second aspect of the present invention, EDS analysis is performed on each of the external additive particles and the analyzed particles are discriminated as to whether they are at least one of titanium oxide and strontium titanate.

When fine particles other than fine particles A and fine particles B are contained in toner according to the first embodiment of the present invention, the fine particles B are separated from the constituent components of the toner using the following method.

1 g of the toner is added to and dispersed in 31 g of chloroform in a vial. To effect dispersion, a dispersion is prepared by treatment for 30 minutes using an ultrasound homogenizer. The treatment conditions are as follows.

ultrasound treatment instrument: VP-050 ultrasound homogenizer (TIETECH Co., Ltd.)

microchip: stepped microchip, 2 mmφ end diameter position of microchip end: center of glass vial, 5 mm height from bottom of vial ultrasound conditions: 30% intensity, 30 minutes; during this treatment, the ultrasound is applied while cooling the vial with ice water to prevent the temperature of the dispersion from rising The dispersion is transferred to a glass tube (50 mL) for swing rotor service, and centrifugal separation is carried out using a centrifugal separator (H-9R, Kokusan Co., Ltd.) and conditions of 58.33 $S^{-1}$ for 30 minutes. Each of the materials constituting the toner are separated in the glass tube after centrifugal separation. Each of the materials is withdrawn and is dried under vacuum conditions (40° C./24 hours). The volume resistivity of each material is measured and the fine particles B that satisfy the conditions required in the present invention are selected and the number-average primary particle diameter is measured.

Method for Measuring Content of Fine Particles B in Toner

The content in the toner is calculated by measuring the amount of fine particles B withdrawn in the "Method for Measuring the Number-Average Primary Particle Diameter of the Fine Particles B".

Method for Measuring Percentage for Area Occupied by Fine Particles A2

Measurement of the percentage for the area occupied by the fine particles A2 is carried out using a transmission electron microscope (TEM) (JEM-2100, JEOL Ltd.).

With regard to sample preparation, the toner to be observed is thoroughly dispersed in a normal temperature-curable epoxy resin. This is followed by curing for 2 days in an atmosphere with a temperature of 35° C. to provide a cured product, which either as such or frozen is converted, using a microtome equipped with a diamond blade, into thin-section samples for observation.

With regard to the toner to be observed by TEM, the circle equivalent diameter is determined from the cross-sectional area in the electron transmission micrograph, and the target particles are taken to be particles for which this value is present in a window that is ±10% of the weight-average particle diameter determined by the method described below using a Coulter Counter. The following toner cross section image analysis is carried out on 100 of these target particles.

"Image-Pro Plus 5.1J" (Media Cybernetics, Inc.) image processing software is used for image analysis.

The discrimination of fine particles A1 from fine particles A2 is described in the following. When just a portion of a fine particle A is embedded in the toner particle, such a fine particle A is regarded as being embedded when the length of the segment where the toner particle is in contact with the fine particle A is at least 50% of the length of the periphery of the fine particle A, and is scored as a fine particle A1. When the length of the segment where the toner particle is in contact with the fine particle A is less than 50% of the length of the periphery of the fine particle A, such a fine particle A is regarded as not embedded and is scored as a fine particle A2.

The region in the toner cross section used for image analysis is described in the following. The region extends in the inward direction of the toner to the location 30 nm inside from the toner particle surface. The region extends in the toner outward direction to the outermost surface of the toner. In a single toner particle, there are parts where a fine particle A forms the outermost surface and parts where the toner particle forms the outermost surface. The region from the location 30 nm inside from the toner particle surface to the outermost surface of the toner is regarded as the surface vicinity region. When all or a portion of a fine particle A embedded in the toner particle is contained in the toner to the inside of the surface vicinity region, the area of this portion is not included in the area for A1.

The percentage for the area occupied by fine particles A2 is calculated with reference to the total of the area occupied by fine particles A1 and fine particles A2 that are present in the surface vicinity region. The average value for 100 target particles is used for the area percentage.

When the toner contains an external additive other than fine particles A, analysis is carried out in an analogous fashion as in the method described in "Method for Measuring the Number-Average Primary Particle Diameter of the Fine Particles A", except that a transmission electron microscope (TEM) is used. EDS analysis is performed on each of the external additive particles during toner observation, and the determination is made as to whether an analyzed particle is a fine particle A based on the presence/absence of an Si element peak.

Method for Measuring Percentage for Area Occupied by Fine Particles B2

The percentage for the area occupied by the fine particles B2 is calculated in an analogous fashion as for the method for measuring the percentage for the area occupied by the fine particles A2.

When the toner contains an external additive other than the fine particles B, EDS analysis is carried out on the individual particles of the external additive during observation of the toner and the fine particles C are identified by comparing the ratio (Ti/O ratio) for the Ti and O element contents (atomic %), or the ratio (Sr/Ti/O ratio) for the Sr, Ti, and O element contents (atomic %), with a standard. The standard for titanium oxide is acquired from FUJIFILM Wako Pure Chemical Corporation (CAS No.: 1317-80-2), and the standard for strontium titanate is obtained from FUJIFILM Wako Pure Chemical Corporation (CAS No.: 12060-59-2).

Method for Measuring Percentage for Area Occupied by Fine Particles C2

The percentage for the area occupied by fine particles C2 is calculated in an analogous fashion as for the method for measuring the percentage for the area occupied by the fine particles A2.

When the toner contains an external additive other than the fine particles C, EDS analysis is carried out on the individual particles of the external additive during observation of the toner and the fine particles C are identified by comparing the ratio (Si/O ratio) for the Si and O element contents (atomic %) with a standard. HDK V15 (Asahi Kasei Corporation) is used as the standard for silica fine particles.

Method for Measuring Type of Fine Particles C and Number-average Primary Particle Diameter of Fine Particles C Measurement of the number-average primary particle diameter of the fine particles C is performed using an "S-4800" scanning electron microscope (product name, Hitachi, Ltd.). Observation is carried out on the toner to which fine particles C have been added; in a visual field enlarged by a maximum of 50,000×, the long diameter of the primary particles of 100 randomly selected fine particles C is measured; and the number-average particle diameter is determined. The enlargement factor in the observation is adjusted as appropriate depending on the size of the fine particles C.

When the fine particles C can be independently acquired as such, measurement can also be performed on these fine particles C as such.

When the toner contains an external additive other than the fine particles C, EDS analysis is carried out on the individual particles of the external additive during observation of the toner and the fine particles C are identified by comparing the ratio (Si/O ratio) for the Si and O element contents (atomic %) with a standard. HDK V15 (Asahi Kasei Corporation) is used as the standard for silica fine particles.

Method for Measuring Total Coverage Ratio by Fine Particles A1 and Fine Particles A2

The total coverage ratio (unit:area %) of the toner particle by the fine particles A1 and fine particles A2 (collectively referred to as the "organosilicon polymer particles" in this section) is measured by observation and image measurement with a scanning electron microscope. The previously referenced S-4800 (product name) Hitachi Ultrahigh Resolution Field Emission Scanning Electron Microscope is used.

The image acquisition conditions are as follows.

When the toner contains both organosilicon polymer particles and silica fine particles, the organosilicon polymer particles are identified by comparing the ratio (Si/O ratio) for the Si and O element contents (atomic %) with a standard. EDS analysis is carried out under the same conditions on standards for both the organosilicon polymer particles and silica fine particles to obtain the element content (atomic %) for both the Si and O. Using A for the Si/O ratio for the organosilicon polymer particles and B for the Si/O ratio for the silica fine particles, measurement conditions are selected whereby A is significantly larger than B. Specifically, the measurement is run ten times under the same conditions on the standards and the arithmetic mean value is obtained for both A and B. Measurement conditions are selected whereby the obtained average values satisfy AB>1.1.

When the Si/O ratio for a fine particle to be classified is on the A side from [(A+B)/2], the fine particle is then scored as an organosilicon polymer particle.

Tospearl 120A (Momentive Performance Materials Japan LLC) is used as the standard for the organosilicon polymer particles, and HDK V15 (Asahi Kasei Corporation) is used as the standard for the silica fine particles.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting Conditions for Observation with S-4800

The coverage ratio by the organosilicon polymer particles is determined using the image obtained by observation of the backscattered electron image with the S-4800. The coverage ratio of the organosilicon polymer particles can be measured at good accuracy using the backscattered electron image due to the low charge up in comparison to the two-dimensional electron image.

Liquid nitrogen is introduced to the brim of the anti-contamination trap attached to the S-4800 case body and standing for 30 minutes is carried out. The "PC-SEM" of the S-4800 is started and flashing is performed (the FE chip, which is the electron source, is cleaned). The acceleration voltage display area in the control panel on the screen is clicked and the [Flashing] button is pressed to open the flashing execution dialog. A flashing intensity of 2 is confirmed and execution is carried out. The emission current due to flashing is confirmed to be 20 μA to 40 μA. The specimen holder is inserted in the specimen chamber of the S-4800 case body. [Home] is pressed on the control panel to transfer the specimen holder to the observation position. The acceleration voltage display area is clicked to open the HV setting dialog and the acceleration voltage is set to [0.8 kV] and the emission current is set to [20 μA]. In the [Base] tab of the operation panel, signal selection is set to [SE], [Upper (U)] and [+BSE] are selected for the SE detector, and the instrument is placed in backscattered electron image observation mode by selecting [L. A. 100] in the selection box to the right of [+BSE].

Similarly, in the [Base] tab of the operation panel, the probe current of the electron optical system condition block is set to [Normal]; the focus mode is set to [UHR]; and WD is set to [3.0 mm]. The [ON] button in the acceleration voltage display area of the control panel is pressed to apply the acceleration voltage.

(3) Focus Adjustment

The magnification is set to 5,000× (5 k) by dragging within the magnification indicator area of the control panel. Adjustment of the aperture alignment is carried out when some degree of focus has been obtained in the visual field as a whole by turning the [COARSE] focus knob on the operation panel. [Align] in the control panel is clicked and the alignment dialog is displayed and [Beam] is selected. The displayed beam is migrated to the center of the concentric circles by turning the STIGMA/ALIGNMENT knobs (X, Y) on the operation panel. [Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. This operation is repeated an additional two time to achieve focus.

Then, with the center point of the largest diameter for the target toner brought to the center of the measurement screen, the magnification is set to 10,000× (10 k) by dragging within the magnification indicator area of the control panel. Adjustment of the aperture alignment is carried out when some degree of focus has been obtained by turning the [COARSE] focus knob on the operation panel. [Align] in the control panel is clicked and the alignment dialog is displayed and [Beam] is selected. The displayed beam is migrated to the center of the concentric circles by turning the STIGMA/ALIGNMENT knobs (X, Y) on the operation panel.

[Aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. The magnification is then set to 50,000× (50 k); focus adjustment is performed as above using the focus knob and the STIGMA/ALIGNMENT knobs; and re-focusing is performed using autofocus. This operation is repeated to achieve focus. The accuracy of measurement of the coverage ratio readily declines when the plane of observation has a large angle of inclination, and for this reason simultaneous focus of the plane of observation as a whole is selected during focus adjustment and the analysis is carried out with selection of the smallest possible surface inclination.

(4) Image Storage

Brightness adjustment is performed using the ABC mode, and a photograph with a size of 640×480 pixels is taken and saved. Analysis is carried out as follows using this image file. One photograph is taken per one toner, and images are obtained for at least 100 or more particles of toner.

The observed image is binarized using ImageJ image processing software (can be obtained from https://imagej.nih.gov/ij/). After binarization, the particle diameter and circularity of the qualifying organosilicon polymer particles are set via [Analyze]–[Analyze Particles] and only the organosilicon polymer particles are extracted and the coverage ratio (unit:area %) for the organosilicon polymer particles on the toner particle is determined.

This measurement is performed on 100 binarized images, and the average value of the coverage ratio (unit:area %) for the organosilicon polymer particles is taken to be the coverage ratio for the organosilicon polymer particles.

Method for Measuring Dispersity Evaluation Index for Fine Particles A

The dispersity evaluation index for the fine particles A at the toner surface is determined using an "S-4800" scanning electron microscope. In a visual field enlarged by 10,000×, observation at an acceleration voltage of 1.0 kV is performed in the same visual field of the toner to which fine particles A have been externally added. The determination is carried out as described in the following using "Image-Pro Plus 5.1J" (Media Cybernetics, Inc.) image processing software.

Binarization is performed such that only fine particles A are extracted; the number n of the fine particles A and the barycentric coordinates for all the fine particles A are determined; and the distance do min to the nearest-neighbor fine particle A is determined for each fine particle A. The dispersity is given by the following formula using d ave for the average of the nearest-neighbor distances between fine particles A in the image.

$$\text{Dispersity Evaluation Index} = \sqrt{\frac{\sum_1^n (dn\,\min d\,ave)^2}{n}} / d\,ave$$

The dispersity is determined by the aforementioned procedure on 50 particles of toner randomly selected for observation, and the average value thereof is used as the dispersity evaluation index. A smaller dispersity evaluation index indicates a better dispersity.

Method for Measuring Dispersity Evaluation Index for Fine Particles B

The dispersity evaluation index for the fine particles B is measured using the same method as used to measure the dispersity evaluation index for the fine particles A.

Method for Measuring Melting Point of Waxes and Glass Transition Temperature Tg of Toner Particles The melting point of the waxes and the glass transition temperature Tg of the toner particles is measured using a "Q1000" differential scanning calorimeter (TA Instruments) in accordance with ASTM D 3418-82. Temperature correction in the instrument detection section is performed using the melting points of indium and zinc, and the amount of heat is corrected using the heat of fusion of indium.

Specifically, 3 mg of the sample (wax, toner) is exactly weighed out and this is introduced into an aluminum pan; an empty aluminum pan is used for reference. The sample is submitted to measurement at a ramp rate of 10° C./min in a measurement temperature range of 30° C. to 200° C. For the measurement, the temperature is raised at a ramp rate of 10° C./min to 200° C. and is then reduced at a ramp down rate of 10° C./min to 30° C.; this is followed by reheating at a ramp rate of 10° C./min. The properties stipulated for the present invention are determined using the DSC curve obtained in this second heating step. The melting point of the sample is taken to be the temperature in this DSC curve of the maximum endothermic peak in the DSC curve in the temperature range from 30° C. to 200° C. The glass transition temperature Tg (° C.) is taken to be the point in this DSC curve at the intersection between the DSC curve and the line for the midpoint for the baselines for prior to and subsequent to the appearance of the change in the specific heat.

Measurement of Average Circularity of Toner

The average circularity of the toner is measured using an "FPIA-3000" (Sysmex Corporation), a flow particle image analyzer, and using the measurement and analysis conditions from the calibration process.

The specific measurement procedure is as follows.

First, approximately 20 mL of deionized water from which solid impurities and the like have been removed in advance is introduced into a glass vessel. To this is added as dispersing agent 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, from Wako Pure Chemical Industries, Ltd.).

0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C.

Using a benchtop ultrasound cleaner/disperser that has an oscillation frequency of 50 kHz and an electrical output of 150 W (for example, the "VS-150" (Velvo-Clear Co., Ltd.)) as the ultrasound disperser, a prescribed amount of deionized water is introduced into the water tank and 2 mL of Contaminon N is added to the water tank.

The flow particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 2,000 particles of the toner are measured according to total count mode in HPF measurement mode.

The average circularity of the toner is determined with the binarization threshold value during particle analysis set at 85% and the analyzed particle diameter limited to a circle equivalent diameter from 1.977 μm to less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific Corporation). After this, focal point adjustment is preferably performed every two hours after the start of measurement.

<Method for Measuring Weight-average Particle Diameter (D4) of Toner>

The weight-average particle diameter (D4) of the toner is calculated as shown below. A precision particle diameter distribution measurement apparatus "Coulter Counter Multisizer 3" (registered trademark, by Beckman Coulter, Inc.) relying on a pore electrical resistance method and equipped with a 100 μm aperture tube is used as a measurement apparatus. A dedicated soft are "Beckman Coulter Multisizer 3, Version 3.51" (by Beckman Coulter, Inc.) ancillary to the apparatus, is used for setting measurement conditions and analyzing measurement data. Measurements are performed in 25,000 effective measurement channels.

The aqueous electrolyte solution used in the measurements can be prepared through dissolution of special-grade sodium chloride at a concentration of about 1 mass % in ion-exchanged water; for instance "ISOTON II" (by Beckman Coulter, Inc.) can be used herein.

The dedicated software was set up as follows prior to measurement and analysis.

In the "Changing Standard Operating Mode (SOMME)" screen of the dedicated software, a total count of the control mode is set to 50; 000 particles, a number of runs is set to one, and a Kd value is set to a value obtained using "Standard particles 10.0 μm" (by Beckman Coulter; inc.).

The "threshold/noise level measuring button" is pressed to thereby automatically set a threshold value and a noise level. Then the current is set to 1600 μA, the gain is set to 2, the electrolyte solution is set to ISOTON II; and "flushing of the aperture tube following measurement" is ticked.

In the "setting conversion from pulses to particle size" screen of the dedicated software, the bin interval is set to a logarithmic particle diameter, the particle diameter bin is set to 256 particle diameter bins, and the particle diameter range is set to range from 2 μm to 60 μm.

Specific measurement methods are as described below (1) Herein about 200 mL of the aqueous electrolyte solution is placed in a 250 mL round-bottomed glass beaker dedicated to Multisizer 3. The beaker is set on a sample stand and is stirred counterclockwise with a stirrer rod at 24 rotations per second. Debris and air bubbles are then removed from the aperture tube by the "aperture tube flush" function of the dedicated software.

(2) Then 30 mL of the aqueous electrolyte solution is placed in a 100 mL flat-bottomed glass beaker, and about 0.3 mL of a dilution obtained by diluting "Contaminon N" (10 mass % aqueous solution of a pH 7 neutral detergent for cleaning of precision instruments, comprising a nonionic surfactant; an anionic surfactant and an organic builder, by Wako Pure Chemical Industries, Ltd.) thrice by mass in ion-exchanged water is added thereto as a dispersant.

(3) About 3.3 L of ion-exchanged water is placed in a water tank of an ultrasonic disperser (Ultrasonic Dispersion System Tetora 150; Nikkaki Bios Co., Ltd.) having an electrical output of 120 W and internally equipped with two oscillators that oscillate at a frequency of 50 kHz and are disposed at a phase offset of 180 degrees, and about 2 mL of the above Contaminon N are added into the water tank. (1) The beaker of (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, about 10 mg of the toner are added little by little to the aqueous electrolyte solution, to be dispersed therein. The ultrasonic dispersion treatment is further continued for 60 seconds. The water temperature of the water tank at the time of ultrasonic dispersion is adjusted as appropriate to lie in the range of from 10° C. to 40° C.

(6) The aqueous electrolyte solution of (5) containing the dispersed toner is added dropwise, using a pipette, to the round-bottomed beaker of (1) set on the sample stand, to adjust the measurement concentration to 5%. A measurement is then performed until the number of measured particles reaches 50,000.

(7) Measurement data is analyzed using the dedicated software ancillary to the apparatus, to calculate the weight-average particle diameter (D4). The "average diameter" in the "analysis/volume statistics (arithmetic average)" screen, when graph/% by volume is selected in the dedicated software, yields herein the weight-average particle diameter (D4).

EXAMPLES

The present invention is described in greater detail in the following using examples and comparative examples, but the present invention is in no way limited thereto or thereby. The "parts" used in the examples is on a mass basis unless specifically indicated otherwise.

Toner Particle 1 Production Example

Toner Particle 1 Production Example is described in the following.

Preparation of Binder Resin Particle Dispersion 89.5 parts of styrene, 9.2 parts of butyl acrylate, 1.3 parts of acrylic acid, and 3.2 parts of n-lauryl mercaptan were mixed and dissolved. To this solution was added an aqueous solution of 1.5 parts of Neogen RK (Dai-ichi Kogyo Seiyaku Co., Ltd.) dissolved in 150 parts of deionized water and dispersion was carried out. While slowly stirring for 10 minutes, an aqueous solution of 0.3 parts of potassium persulfate dissolved in 10 parts of deionized water was also added. After substitution with nitrogen, an emulsion polymerization was run for 6 hours at 70° C. After the completion of polymerization, the reaction solution was cooled to room temperature and deionized water was added to obtain a resin particle dispersion having a solids fraction concentration of 12.5 mass % and a median diameter of 0.2 μm on a volume basis.

Preparation of Release Agent Dispersion 100 parts of a release agent (behenyl behenate, melting point: 72.1° C.) and 15 parts of Neogen RK were mixed in 385 parts of deionized water and a release agent dispersion was obtained by dispersing for approximately 1 hour using a JN100 wet jet mill (JOKOH Co., Ltd.). The release agent dispersion had a concentration of 20 mass %.

Preparation of Colorant Dispersion 100 parts of "Nipex 35" (Orion Engineered Carbons LLC) as colorant and 15 parts of Neogen RK were mixed in 885 parts of deionized water and a colorant dispersion was obtained by dispersing for approximately 1 hour using a JN100 wet jet mill.

Toner Particle Preparation 265 parts of the resin particle dispersion, 10 parts of the release agent dispersion, and 10 parts of the colorant dispersion were dispersed using a homogenizer (Ultra-Turrax T50, IKA). The temperature in the container was adjusted to 30° C. while stirring, and the pH was adjusted to 5.0 by the addition of 1 mol/L hydrochloric acid. Heating was begun after standing for 3 minutes and the temperature was raised to 50° C. to carry out the production of aggregate particles. While in this condition, the particle diameter of the aggregate particles was measured using a "Coulter Counter Multisizer 3" (registered trademark, Beckman Coulter, Inc.). When the weight-average particle diameter reached 6.2 μm, a 1 mol/L aqueous sodium hydroxide solution was added to adjust the pH to 8.0 and stop particle growth.

This was followed by heating to 95° C. to carry out melt adhesion and sphericization of the aggregate particles. Cooling was begun when the average circularity reached 0.980, and cooling to 30° C. then provided a toner particle dispersion 1.

A toner cake was obtained by subjecting the resulting toner particle dispersion 1 to solid-liquid separation on a pressure filter. This was made into a dispersion again by reslurrying with deionized water, and solid-liquid separation on the aforementioned filter was performed. Reslurrying and solid-liquid separation were repeated until the conductivity of the filtrate reached 5.0 μS/cm or less, after which a final solid-liquid separation was performed to obtain a toner cake. The obtained toner cake was dried in a Flash Jet Dryer air current dryer (Seishin Enterprise Co., Ltd.). The drying conditions were an injection temperature of 90° C. and a dryer outlet temperature of 40° C., and the toner cake feed rate was adjusted in correspondence to the water content of the toner cake to a rate such that the outlet temperature did not deviate from 40° C. The fines and coarse powder were cut using a Coanda effect-based multi-grade classifier to yield a toner particle 1. Toner particle 1 had a weight-average particle diameter (D4) of 6.3 μm, an average circularity of 0.980, and a Tg of 57° C.

Toner Particle 2 Production Example

A toner particle 2 was obtained in an analogous fashion as in the Toner Particle 1 Production Example, except that a paraffin wax (melting point: 75.4° C.) was used in place of the behenyl behenate (melting point: 72.1° C.) in the production of the release agent dispersion in the Toner Particle 1 Production Example. Toner particle 2 had a weight-average particle diameter (D4) of 6.4 μm, an average circularity of 0.981, and a Tg of 58° C.

Fine Particles A-1 Production Example

First Step 360 parts of water was introduced into a reaction vessel fitted with a thermometer and a stirrer, and 15 parts of hydrochloric acid having a concentration of 5.0 mass % was added to provide a uniform solution. While stirring this at a temperature of 25° C., 136.0 parts of methyltrimethoxysilane was added, stirring was performed for 5 hours, and filtration was carried out to obtain a transparent reaction solution containing a silanol compound or partial condensate thereof.

Second Step 440 parts of water was introduced into a reaction vessel fitted with a thermometer and stirrer, and 17 parts of aqueous ammonia having a concentration of 10.0 mass % was added to provide a uniform solution. While stirring this at a temperature of 35° C., 100 parts of the reaction solution obtained in the first step was added dropwise over 0.50 hour, and stirring was performed for 6 hours to obtain a suspension. The resulting suspension was processed with a centrifugal separator and the fine particles were sedimented and withdrawn and were dried for 24 hours with a dryer at a temperature of 200° C. to obtain fine particles A-1.

The obtained fine particles A-1 had a number-average primary particle diameter by observation with a transmission scanning electron microscope of 100 nm and had a shape factor SF-1 of 105.

Fine Particles A-2 to A-10 Production Example

Fine particles A-2 to A-10 were obtained in an analogous fashion as in the Fine Particles A-1 Production Example, except that the silane compound, reaction start temperature, amount of catalyst addition, duration of dropwise addition, and the like were changed as shown in Table 1. The properties of the resulting fine particles A-2 to A-10 are given in Table 1.

TABLE 1

| | First Step | | | | | | | | |
|---|---|---|---|---|---|---|---|---|---|
| Fine | water | hydrochloric acid | reaction temperature | silane compound A | | silane compound B | | silane compound C | |
| Particles | parts | parts | ° C. | name | parts | name | parts | name | parts |
| A-1 | 360 | 15 | 25 | methyltrimethoxysilane | 136.0 | — | — | — | — |
| A-2 | 360 | 13 | 25 | methyltrimethoxysilane | 136.0 | — | — | — | — |
| A-3 | 360 | 20 | 25 | methyltrimethoxysilane | 136.0 | — | — | — | — |
| A-4 | 360 | 16 | 25 | methyltrimethoxysilane | 136.0 | — | — | — | — |
| A-5 | 360 | 15 | 25 | methyltrimethoxysilane | 122.4 | trimethylmethoxysilane | 10.4 | — | — |
| A-6 | 360 | 8 | 25 | pentyltrimethoxysilane | 190.1 | tripentylmethoxysilane | 5.0 | — | — |
| A-7 | 360 | 23 | 25 | methyltrimethoxysilane | 136.0 | — | — | — | — |
| A-8 | 360 | 13 | 25 | methyltrimethoxysilane | 122.4 | trimethylmethoxysilane | 12.0 | tetramethoxysilane | 0.5 |
| A-9 | 360 | 17 | 25 | methyltrimethoxysilane | 115.0 | trimethylmethoxysilane | 20.8 | dimethyldimethoxysilane | 30.0 |
| A-10 | 360 | 15 | 25 | methyltrimethoxysilane | 100.0 | trimethylmethoxysilane | 20.0 | dimethyldimethoxysilane | 70.0 |

| | Second Step | | | | | | | |
|---|---|---|---|---|---|---|---|---|
| Fine Particles | reaction solution obtained in first step parts | water parts | aqueous ammonia parts | reaction start temperature ° C. | duration of dropwise addition hours | number-average primary particle diameter nm | SF-1 | * |
| A-1 | 100 | 440 | 17 | 35 | 0.50 | 100 | 105 | 1.00 |
| A-2 | 100 | 440 | 15 | 40 | 1.00 | 50 | 102 | 1.00 |
| A-3 | 100 | 440 | 21 | 30 | 0.25 | 250 | 101 | 1.00 |
| A-4 | 100 | 600 | 17 | 35 | 0.50 | 110 | 115 | 1.00 |
| A-5 | 100 | 460 | 17 | 35 | 0.50 | 100 | 104 | 0.91 |
| A-6 | 100 | 440 | 10 | 40 | 2.00 | 20 | 101 | 0.98 |
| A-7 | 100 | 500 | 23 | 30 | 0.17 | 350 | 108 | 1.00 |
| A-8 | 100 | 440 | 17 | 35 | 0.50 | 100 | 104 | 0.88 |
| A-9 | 100 | 540 | 19 | 30 | 0.33 | 150 | 110 | 0.65 |
| A-10 | 100 | 540 | 17 | 30 | 0.30 | 160 | 110 | 0.49 |

* proportion for the area of the peak originating with silicon having the T3 unit structure Fine Particles B-1 Production Example Ilmenite containing 50 mass % $TiO_2$ equivalent was dried for 3 hours at 150° C., followed by the addition of sulfuric acid and dissolution to obtain an aqueous solution of $TiOSO_4$. The obtained aqueous solution was concentrated; 10 parts of a titania sol containing rutile crystals was then added as seed; and hydrolysis was subsequently carried out at 170° C. to obtain an impurity-containing $TiO(OH)_2$ slurry. This slurry was repeatedly washed at pH 5 to 6 to thoroughly remove the sulfuric acid, $FeSO_4$, and impurities, thus yielding a slurry of high-purity metatitanic acid [$TiO(OH)_2$].

This slurry was filtered; 0.5 parts of lithium carbonate ($Li_2CO_3$) was then added; baking was carried out for 3 hours at 250° C.; and milling with a jet mill was repeatedly performed to obtain rutile crystal-containing titanium oxide fine particles. The obtained titanium oxide fine particles were dispersed in ethanol and, while stirring, 5 parts of isobutyltrimethoxysilane per 100 parts of titanium oxide fine particles was added dropwise as a surface treatment agent and a reaction was run with mixing. After drying, a heat treatment was performed for 3 hours at 170° C. and repeated milling was carried out with a jet mill until there were no titanium oxide aggregates, thus yielding fine particles B-1 in the form of titanium oxide fine particles. The properties of fine particles B-1 are given in Table 2.

Fine Particles B-2 Production Example

Fine particles B-2 in the form of titanium oxide fine particles were obtained in an analogous fashion as for fine particles B-1, but using 240° C. for the baking temperature in the Fine Particles B-1 Production Example and changing the isobutyltrimethoxysilane surface treatment agent to 15 parts. The properties of fine particles B-2 are given in Table 2.

Fine Particles B-3 Production Example

Fine particles B-3 in the form of titanium oxide fine particles were obtained in an analogous fashion as for fine particles B-1, but changing the baking temperature in the Fine Particles B-1 Production Example to 260° C. The properties of fine particles B-3 are given in Table 2.

Fine Particles B-4 Production Example

A meta-titanic acid provided by the sulfuric acid method was subjected to an iron removal and bleaching treatment; this was followed by the addition of an aqueous sodium hydroxide solution to bring the pH to 9.0 and the execution of a desulfurization treatment; and neutralization to pH 5.8 was then carried out with hydrochloric acid and filtration and water washing were performed. Water was added to the washed cake to make a slurry having 1.85 mol/L as $TiO_2$; this was followed by the addition of hydrochloric acid to pH 1.0 and the execution of a peptization treatment.

1.88 mol as $TiO_2$ of the desulfurized and peptized meta-titanic acid was collected and was introduced into a 3-L reactor. To this peptized meta-titanic acid slurry was added 2.16 mol of an aqueous strontium chloride solution to provide 1.15 for Sr/Ti (molar ratio), and the $TiO_2$ concentration was then adjusted to 1.039 mol/L.

Then, after heating to 90° C. while stirring and mixing, 440 mL of a 10 mol/L aqueous sodium hydroxide solution was added over 45 minutes and stirring was then continued for 1 hour at 95° C. to finish the reaction.

The reaction slurry was cooled to 50° C. and hydrochloric acid was added to provide a pH of 5.0 and stirring was continued for 1 hour. The resulting sediment was washed by decantation.

The sediment-containing slurry was adjusted to 40° C. and hydrochloric acid was added to adjust the pH to 2.5. 4.0 mass %, with reference to the solids fraction, of n-octyltriethoxysilane was then added and holding while stirring was continued for 10 hours. A 5 mol/L aqueous sodium hydroxide solution was added to adjust the pH to 6.5 and stirring was continued for 1 hour. This was followed by filtration and washing to yield a cake, which was dried for 8 hours in a 120° C. atmosphere to obtain fine particles B-4 in the form of strontium titanate fine particles. The properties of fine particles B-4 are given in Table 2.

Fine Particles B-5 Production Example

Oxygen at 50 $Nm^3/h$ and argon gas at 2 $Nm^3/h$ were fed to a combustion chamber to form a space for the ignition of aluminum powder. Aluminum powder (average particle diameter=approximately 45 μm, feed rate=20 kg/h) was passed through the combustion chamber, along with nitrogen gas (feed rate=3.5 $Nm^3/h$), from an aluminum powder feeder and was fed to a reaction furnace. The aluminum powder was oxidized in the reaction furnace into alumina particles. The alumina particles obtained after passage through the reaction furnace were classified to remove the fines and coarse powder and yield fine particles B-5 in the form of alumina fine particles. The properties of fine particles B-5 are given in Table 2.

TABLE 2

| Fine Particles | Material | Volume Resistivity (Ωm) | Number-average PrimaryParticle Diameter (nm) |
|---|---|---|---|
| B-1 | titanium oxide | $3.0 \times 10^5$ | 20 |
| B-2 | titanium oxide | $7.8 \times 10^7$ | 15 |
| B-3 | titanium oxide | $5.5 \times 10^5$ | 55 |
| B-4 | strontium titanate | $3.4 \times 10^7$ | 30 |
| B-5 | alumina | $2.9 \times 10^9$ | 45 |

Fine Particles C-1 Production Example 100 parts of a fumed silica (BET: 200 $m^2/g$), produced by a dry method and used as the effective component, was treated with 15 parts of hexamethyldisilazane and was thereafter subjected to an oil treatment with 13 parts of a dimethylsilicone oil that had a viscosity at 25° C. of 100 $mm^2/s$. This was followed by pulverization and classification using a sieve to obtain fine particles C-1 in the form of silica fine particles 1. The properties of fine particles C-1 are given in Table 3.

Fine Particles C-2 Production Example 100 parts of a fumed silica (BET: 75 $m^2/g$), produced by a dry method and used as the effective component, was treated with 10 parts of hexamethyldisilazane and was thereafter subjected to an oil treatment with 10 parts of a dimethylsilicone oil that had a viscosity at 25° C. of 100 $mm^2/s$. This was followed by pulverization and classification using a sieve to obtain fine particles C-2 in the form of silica fine particles. The properties of fine particles C-2 are given in Table 3.

TABLE 3

| Fine Particles | Material | Number-average Primary Particle Diameter (nm) |
|---|---|---|
| C-1 | fumed silica | 15 |
| C-2 | fumed silica | 55 |

Toner 1 Production Example

First, in a first step, the toner particle 1 and the fine particles B-1 were mixed using an FM mixer (Model FM10C, Nippon Coke & Engineering Co., Ltd.).

100 parts of toner particle 1 and 1.0 parts of fine particles B-1 were introduced with the water temperature in the jacket of the FM mixer made stable at 50° C.±1° C. Mixing was begun at a peripheral velocity for the stirring blade of 38 m/sec, and, while controlling the water temperature and flow rate in the jacket so as to keep the temperature in the tank stable at 50° C.±1° C., mixing was performed for 7 minutes to obtain a mixture of the toner particle 1 and the fine particles B-1.

Then, in a second step, fine particles A-1 and fine particles C-1 were added to the mixture of toner particle 1 and fine particles B-1 using an FM mixer (Model FM10C, Nippon Coke & Engineering Co., Ltd.). With the water temperature in the jacket of the FM mixer made stable at 25° C.±1° C., 2.0 parts of fine particles A-1 and 0.8 parts of fine particles C-1 were introduced per 100 parts of toner particle 1. Mixing was begun at a peripheral velocity for the stirring blade of 28 m/sec, and, while controlling the water temperature and flow rate in the jacket so as to keep the temperature in the tank stable at 25° C.±1° C., mixing was performed for 4 minutes; this was followed by sieving on a mesh with an aperture of 75 μm to obtain a toner 1. The production conditions for toner 1 are given in Table 4 and the properties of toner 1 in Table 5.

TABLE 4

| | | First Step | | | | | | | | |
|---|---|---|---|---|---|---|---|---|---|---|
| | Toner | Fine particles A | | Fine particles B | | Fine particles C | | | Mixing | Temperature in the tank |
| | particle | Type | Parts | Type | Parts | Type | Parts | Mixer | conditions | (±1° C.) |
| Toner 1 | 1 | — | — | B-1 | 1.0 | — | — | FM mixer | 38 m/sec × 7 min | 50 |
| Toner 2 | 1 | — | — | B-1 | 1.0 | — | — | FM mixer | 38 m/sec × 7 min | 50 |
| Toner 3 | 1 | — | — | B-1 | 1.0 | — | — | FM mixer | 38 m/sec × 7 min | 50 |
| Toner 4 | 1 | — | — | B-1 | 1.0 | — | — | FM mixer | 38 m/sec × 7 min | 50 |
| Toner 5 | 1 | — | — | B-1 | 1.0 | — | — | FM mixer | 38 m/sec × 7 min | 50 |
| Toner 6 | 1 | — | — | B-1 | 1.0 | — | — | FM mixer | 38 m/sec × 7 min | 50 |
| Toner 7 | 2 | — | — | B-1 | 1.0 | — | — | FM mixer | 38 m/sec × 7 min | 50 |
| Toner 8 | 1 | — | — | B-1 | 1.0 | — | — | FM mixer | 38 m/sec × 7 min | 50 |
| Toner 9 | 1 | — | — | B-1 | 1.0 | — | — | FM mixer | 38 m/sec × 7 min | 50 |
| Toner 10 | 1 | — | — | B-1 | 1.0 | — | — | FM mixer | 38 m/sec × 7 min | 50 |
| Toner 11 | 1 | — | — | B-1 | 1.0 | — | — | FM mixer | 38 m/sec × 7 min | 50 |
| Toner 12 | 1 | — | — | B-1 | 1.0 | — | — | FM mixer | 38 m/sec × 7 min | 50 |
| Toner 13 | 1 | — | — | B-2 | 1.0 | — | — | FM mixer | 38 m/sec × 7 min | 50 |
| Toner 14 | 1 | — | — | B-1 | 0.2 | — | — | FM mixer | 38 m/sec × 7 min | 50 |
| Toner 15 | 1 | — | — | B-1 | 2.8 | — | — | FM mixer | 38 m/sec × 7 min | 50 |
| Toner 16 | 1 | — | — | B-1 | 1.0 | — | — | FM mixer | 38 m/sec × 7 min | 45 |
| Toner 17 | 1 | — | — | B-3 | 1.0 | — | — | FM mixer | 38 m/sec × 7 min | 50 |
| Toner 18 | 1 | — | — | B-3 | 1.0 | — | — | FM mixer | 38 m/sec × 2 min | 50 |
| Toner 19 | 1 | — | — | B-1 | 1.0 | — | — | FM mixer | 38 m/sec × 7 min | 50 |
| Toner 20 | 1 | — | — | B-1 | 1.0 | C-1 | 0.8 | FM mixer | 38 m/sec × 7 min | 50 |
| Toner 21 | 1 | — | — | B-4 | 1.2 | — | — | FM mixer | 38 m/sec × 7 min | 50 |
| Toner 22 | 1 | — | — | B-1 | 1.0 | — | — | FM mixer | 38 m/sec × 7 min | 50 |
| Toner 23 | 1 | — | — | B-1 | 1.0 | — | — | FM mixer | 38 m/sec × 7 min | 50 |
| Comparative toner 1 | 1 | A-1 | 2.0 | B-1 | 1.0 | C-1 | 0.8 | FM mixer | 28 m/sec × 4 min | 25 |
| Comparative toner 2 | 1 | A-1 | 2.0 | B-4 | 1.2 | C-1 | 0.8 | FM mixer | 28 m/sec × 4 min | 25 |
| Comparative toner 3 | 1 | — | — | B-5 | 1.0 | — | — | FM mixer | 38 m/sec × 7 min | 50 |
| Comparative toner 4 | 1 | — | — | B-1 | 1.0 | — | — | FM mixer | 38 m/sec × 7 min | 50 |
| Comparative toner 5 | 1 | — | — | B-1 | 1.0 | — | — | FM mixer | 38 m/sec × 7 min | 50 |

TABLE 4-continued

| | | | | | | | | | | |
|---|---|---|---|---|---|---|---|---|---|---|
| Comparative toner 6 | 1 | — | — | B-1 | 0.04 | — | — | FM mixer | 38 m/sec × 7 min | 50 |
| Comparative toner 7 | 1 | — | — | B-1 | 3.5 | — | — | FM mixer | 38 m/sec × 7 min | 50 |
| Comparative toner 8 | 1 | — | — | B-1 | 1.0 | — | — | FM mixer | 38 m/sec × 7 min | 50 |
| Comparative toner 9 | 1 | — | — | B-1 | 1.0 | — | — | FM mixer | 38 m/sec × 7 min | 50 |

| | Second Step | | | | | | | Content in Toner (mass %) | |
|---|---|---|---|---|---|---|---|---|---|
| | Fine particles A | | Fine particles C | | | Mixing | Temperature in the tank | Fine particles | Fine particles |
| | Type | Parts | Type | Parts | Mixer | conditions | (±1° C.) | A | B |
| Toner 1 | A-1 | 2.0 | C-1 | 0.8 | FM mixer | 28 m/sec × 4 min | 25 | 1.9 | 1.0 |
| Toner 2 | A-1 | 0.8 | C-1 | 0.8 | FM mixer | 28 m/sec × 4 min | 25 | 0.8 | 1.0 |
| Toner 3 | A-1 | 5.0 | C-1 | 0.8 | FM mixer | 28 m/sec × 4 min | 25 | 4.7 | 0.9 |
| Toner 4 | A-2 | 1.3 | C-1 | 0.8 | FM mixer | 28 m/sec × 4 min | 25 | 1.3 | 1.0 |
| Toner 5 | A-3 | 5.6 | C-1 | 0.8 | FM mixer | 28 m/sec × 4 min | 25 | 5.2 | 0.9 |
| Toner 6 | A-1 | 2.0 | C-1 | 0.8 | FM mixer | 28 m/sec × 4 min | 25 | 1.9 | 1.0 |
| Toner 7 | A-1 | 2.0 | C-1 | 0.8 | FM mixer | 28 m/sec × 4 min | 25 | 1.9 | 1.0 |
| Toner 8 | A-4 | 2.5 | C-1 | 0.8 | FM mixer | 28 m/sec × 4 min | 25 | 2.4 | 1.0 |
| Toner 9 | A-5 | 2.0 | C-1 | 0.8 | FM mixer | 28 m/sec × 4 min | 25 | 1.9 | 1.0 |
| Toner 10 | A-6 | 0.6 | C-1 | 0.8 | FM mixer | 28 m/sec × 4 min | 25 | 0.6 | 1.0 |
| Toner 11 | A-7 | 6.1 | C-1 | 0.8 | FM mixer | 28 m/sec × 4 min | 25 | 5.7 | 0.9 |
| Toner 12 | A-8 | 2.0 | C-1 | 0.8 | FM mixer | 28 m/sec × 4 min | 25 | 1.9 | 1.0 |
| Toner 13 | A-1 | 2.0 | C-1 | 0.8 | FM mixer | 28 m/sec × 4 min | 25 | 1.9 | 1.0 |
| Toner 14 | A-1 | 2.0 | C-1 | 0.8 | FM mixer | 28 m/sec × 4 min | 25 | 1.9 | 0.2 |
| Toner 15 | A-1 | 2.0 | C-1 | 0.8 | FM mixer | 28 m/sec × 4 min | 25 | 1.9 | 2.7 |
| Toner 16 | A-1 | 2.0 | C-1 | 0.8 | FM mixer | 28 m/sec × 4 min | 25 | 1.9 | 1.0 |
| Toner 17 | A-1 | 2.0 | C-1 | 0.8 | FM mixer | 28 m/sec × 4 min | 25 | 1.9 | 1.0 |
| Toner 18 | A-1 | 2.0 | C-1 | 0.8 | FM mixer | 28 m/sec × 4 min | 25 | 1.9 | 1.0 |
| Toner 19 | A-1 | 2.0 | C-2 | 0.8 | FM mixer | 28 m/sec × 4 min | 25 | 1.9 | 1.0 |
| Toner 20 | A-1 | 2.0 | — | — | FM mixer | 28 m/sec × 4 min | 25 | 1.9 | 1.0 |
| Toner 21 | A-1 | 2.0 | C-1 | 0.8 | FM mixer | 28 m/sec × 4 min | 25 | 1.9 | 1.2 |
| Toner 22 | A-1 | 5.0 | — | — | FM mixer | 28 m/sec × 4 min | 25 | 4.7 | 0.9 |
| Toner 23 | A-9 | 2.0 | C-1 | 0.8 | FM mixer | 28 m/sec × 4 min | 25 | 1.9 | 1.0 |
| Comparative toner 1 | — | — | — | — | — | — | — | 1.9 | 1.0 |
| Comparative toner 2 | — | — | — | — | — | — | — | 1.9 | 1.2 |
| Comparative toner 3 | A-1 | 2.0 | C-1 | 0.8 | FM mixer | 28 m/sec × 4 min | 25 | 1.9 | 1.0 |
| Comparative toner 4 | silica | 3.5 | C-1 | 0.8 | FM mixer | 28 m/sec × 4 min | 25 | 3.3 | 0.9 |
| Comparative toner 5 | A-1 | 0.4 | C-1 | 0.8 | FM mixer | 28 m/sec × 4 min | 25 | 0.4 | 1.0 |
| Comparative toner 6 | A-1 | 2.0 | C-1 | 0.8 | FM mixer | 28 m/sec × 4 min | 25 | 1.9 | 0.0 |
| Comparative toner 7 | A-1 | 2.0 | C-1 | 0.8 | FM mixer | 28 m/sec × 4 min | 25 | 1.9 | 3.3 |
| Comparative toner 8 | A-10 | 2.0 | C-1 | 0.8 | FM mixer | 28 m/sec × 4 min | 25 | 1.9 | 1.0 |

TABLE 4-continued

| | | | | | | | | |
|---|---|---|---|---|---|---|---|---|
| Comparative toner 9 | A-1 | 5.5 | — | — | FM mixer | 28 m/sec × 4 min | 25 | 5.2 | 0.9 |

* silica: (number-average primary particle diameter: 105 nm, SF-1: 101, proportion for area of peak originating with silicon having T3 unit structure: 0%)

TABLE 5

| | Total coverage ratio by A1 and A2 (%) | Percentage for area occupied by A2 (area %) | Percentage for area occupied by B2 (area %) | Percentage for area occupied by C2 (area %) | Dispersity Evaluation Index | |
|---|---|---|---|---|---|---|
| | | | | | Fine particles A | Fine particles B |
| Toner 1 | 30 | 95 | 30 | 76 | 1.2 | 0.3 |
| Toner 2 | 12 | 94 | 30 | 78 | 1.7 | 0.3 |
| Toner 3 | 69 | 97 | 30 | 75 | 0.6 | 0.3 |
| Toner 4 | 33 | 73 | 30 | 78 | 1.0 | 0.3 |
| Toner 5 | 31 | 97 | 30 | 77 | 1.7 | 0.3 |
| Toner 6 | 27 | 92 | 30 | 75 | 2.2 | 0.4 |
| Toner 7 | 31 | 95 | 28 | 76 | 1.1 | 0.3 |
| Toner 8 | 30 | 93 | 30 | 75 | 0.8 | 0.3 |
| Toner 9 | 31 | 96 | 30 | 74 | 1.3 | 0.3 |
| Toner 10 | 30 | 70 | 30 | 74 | 0.8 | 0.3 |
| Toner 11 | 31 | 98 | 30 | 75 | 1.8 | 0.3 |
| Toner 12 | 30 | 95 | 30 | 75 | 1.3 | 0.3 |
| Toner 13 | 31 | 95 | 22 | 74 | 1.3 | 0.2 |
| Toner 14 | 30 | 94 | 15 | 76 | 1.2 | 0.4 |
| Toner 15 | 30 | 95 | 33 | 75 | 1.3 | 0.1 |
| Toner 16 | 31 | 97 | 47 | 79 | 1.2 | 0.1 |
| Toner 17 | 30 | 95 | 34 | 76 | 1.3 | 0.3 |
| Toner 18 | 31 | 95 | 29 | 74 | 1.3 | 0.6 |
| Toner 19 | 30 | 96 | 30 | 81 | 1.3 | 0.3 |
| Toner 20 | 32 | 95 | 30 | 33 | 1.2 | 0.3 |
| Toner21 | 30 | 94 | 32 | 77 | 1.3 | 0.3 |
| Toner 22 | 68 | 97 | 30 | — | 0.6 | 0.3 |
| Toner 23 | 29 | 98 | 30 | 76 | 1.5 | 0.3 |
| Comparative toner 1 | 31 | 96 | 68 | 79 | 1.2 | 0.3 |
| Comparative toner 2 | 32 | 95 | 73 | 80 | 1.3 | 0.3 |
| Comparative toner 3 | 33 | 94 | 33 | 78 | 1.4 | 0.3 |
| Comparative toner 4 | 32 | 93 | 30 | 78 | 1.6 | 0.3 |
| Comparative toner 5 | 7 | 91 | 30 | 81 | 2.3 | 0.3 |
| Comparative toner 6 | 32 | 97 | 24 | 80 | 1.4 | 0.5 |
| Comparative toner 7 | 31 | 96 | 43 | 78 | 1.5 | 0.1 |
| Comparative toner 8 | 25 | 97 | 30 | 75 | 1.7 | 0.3 |
| Comparative toner 9 | 75 | 98 | 30 | — | 0.5 | 0.3 |

Toners 2 to 23 and Comparative Toners 1 to 9 Production Example

Toners 2 to 23 and comparative toners 1 to 9 were obtained in an analogous fashion as in the Toner 1 Production Example, but using, in the Toner 1 Production Example, the toner particle, fine particles A to C added in the first step and second step and their number of parts of addition, and mixing conditions as shown in Table 4. The properties of toners 2 to 23 and comparative toners 1 to 9 are given in Table 5.

Example 1

Toner 1 was filled into a cartridge for an LBP652C Laser Printer from Canon, Inc., and the following evaluations were performed. The results of the evaluations are given in Table 6.

Evaluation of Image Density

The image density was evaluated in a high-temperature, high-humidity environment (temperature of 30.0° C., relative humidity of 80%). An image output test, which is considered to be a long-term durability test, was performed in which a total of 12,000 prints was output in a mode set up such that the machine was temporarily stopped between jobs, after which the next job was started. One print of a horizontal line pattern with a print percentage of 1% constituted one job. The image density was measured at the 1st print and the 12,000th print. A4 color laser copy paper (Canon, Inc., 80 g/m$^2$) was used. The image density was measured by outputting a 5 mm×5 mm solid black patch image and measuring the reflection density using a MacBeth reflection densitometer (MacBeth Corporation) and an SPI filter. Larger numerical values indicate a better developing performance.

A: The image density is at least 1.45.
B: The image density is from 1.40 to 1.44.
C: The image density is from 1.35 to 1.39.
D: The image density is equal to or less than 1.34.

Evaluation of Image Density Uniformity

In order to focus largely on the influence of the transferability, the evaluation of the image density uniformity was carried out in a high-temperature, high-humidity environment (temperature of 30.0° C., relative humidity of 80%), which was presumed to be more rigorous with regard to the transferability. FOX RIVER BOND paper (110 g/m$^2$), a rough paper, was used for the evaluation.

After measuring the image density on the 1st print and 12,000th print in the long-term durability test in the Evaluation of the Image Density, an image was output that had 5-mm margins at the leading edge and on the right and left and that had a 5 mm×5 mm solid black patch image at a total of 9 locations, i.e., at the 3 locations of right, left, and center, and these at 3 locations on a 30-mm interval in the length direction. The image density was measured on the solid black patch image areas at the 9 locations in the image, and the difference between the largest value and the smallest value among all of the densities was calculated. The image density was measured using a MacBeth reflection densitometer (MacBeth Corporation) and an SPI filter. Smaller numerical values for this difference between the largest value and smallest value indicate a better image density uniformity.

A: The numerical value for the difference between the largest value and smallest value of the image density is not more than 0.05.
B: The numerical value for the difference between the largest value and smallest value of the image density is from 0.06 to 0.10.
C: The numerical value for the difference between the largest value and smallest value of the image density is at least 0.11.

Evaluation of Transferability

The evaluation of the transferability was carried out in a high-temperature, high-humidity environment (temperature of 30.0° C., relative humidity of 85%), which was presumed to be more rigorous with regard to the transferability. FOX RIVER BOND paper (110 g/m$^2$), a rough paper, was used for the evaluation paper. For the transferability, the untransferred toner on the photosensitive member after the transfer of a solid black image was taped over and stripped off with a polyester adhesive tape (No. 31B, width=15 mm) (Nitto Denko Corporation). Here, "C" refers to the value of the MacBeth reflection density of this tape when pasted onto the paper, "D" refers to the MacBeth density of the aforementioned tape pasted on the paper bearing the toner post-transfer and pre-fixing, and "E" refers to the MacBeth density of the tape pasted on unused paper. The following formula was used for an approximate calculation. Larger numerical values indicate a better transferability.

$$\text{transferability (\%)}=\{(D-C)/(D-E)\}\times 100$$

A: The transferability is at least 95%.
B: The transferability is from 90% to less than 95%.
C: The transferability is from 85% to less than 90%.
D: The transferability is from 80% to less than 85%.
E: The transferability is less than 80%.

TABLE 6

| | | High-temperature, High-humidity Environment | | | | | | | | | | | |
|---|---|---|---|---|---|---|---|---|---|---|---|---|---|
| | | Image Density | | | | Transferability | | | | Density Uniformity | | | |
| | | 1st | | 12,000 th | | 1st | | 12,000 th | | 1st | | 12,000 th | |
| Example 1 | toner 1 | A | 1.49 | A | 1.46 | A | 97 | A | 95 | A | 0.01 | A | 0.03 |
| Example 2 | toner 2 | A | 1.47 | B | 1.42 | A | 95 | B | 93 | A | 0.02 | A | 0.03 |
| Example 3 | toner 3 | A | 1.47 | B | 1.42 | A | 95 | B | 92 | A | 0.01 | A | 0.03 |
| Example 4 | toner 4 | A | 1.46 | B | 1.42 | B | 93 | B | 90 | A | 0.02 | A | 0.04 |
| Example 5 | toner 5 | A | 1.46 | B | 1.44 | B | 94 | B | 91 | A | 0.02 | A | 0.03 |
| Example 6 | toner 6 | A | 1.46 | B | 1.43 | A | 95 | C | 87 | A | 0.02 | A | 0.05 |
| Example 7 | toner 7 | A | 1.47 | B | 1.42 | A | 95 | C | 86 | A | 0.02 | A | 0.05 |
| Example 8 | toner 8 | A | 1.46 | B | 1.42 | B | 94 | C | 85 | A | 0.02 | A | 0.05 |
| Example 9 | toner 9 | B | 1.42 | C | 1.38 | A | 95 | C | 85 | B | 0.06 | B | 0.08 |
| Example 10 | toner 10 | B | 1.43 | C | 1.37 | B | 94 | C | 86 | B | 0.07 | B | 0.09 |
| Example 11 | toner 11 | A | 1.46 | C | 1.38 | A | 95 | C | 85 | A | 0.03 | A | 0.05 |
| Example 12 | toner 12 | B | 1.42 | C | 1.38 | A | 95 | C | 85 | B | 0.07 | B | 0.10 |
| Example 13 | toner 13 | A | 1.47 | B | 1.43 | A | 95 | B | 91 | A | 0.02 | A | 0.04 |
| Example 14 | toner 14 | A | 1.46 | B | 1.42 | A | 96 | B | 92 | A | 0.03 | A | 0.04 |
| Example 15 | toner 15 | A | 1.45 | B | 1.41 | A | 95 | B | 92 | A | 0.03 | A | 0.05 |
| Example 16 | toner 16 | A | 1.45 | B | 1.42 | A | 95 | B | 90 | A | 0.02 | A | 0.05 |
| Example 17 | toner 17 | A | 1.45 | B | 1.41 | A | 95 | C | 87 | A | 0.03 | A | 0.05 |
| Example 18 | toner 18 | A | 1.46 | B | 1.41 | B | 93 | D | 83 | A | 0.02 | A | 0.05 |
| Example 19 | toner 19 | A | 1.45 | C | 1.38 | B | 94 | B | 90 | A | 0.03 | B | 0.09 |
| Example 20 | toner 20 | A | 1.46 | C | 1.37 | A | 95 | B | 90 | A | 0.04 | B | 0.09 |
| Example 21 | toner 21 | A | 1.49 | A | 1.45 | A | 96 | A | 95 | A | 0.02 | A | 0.03 |
| Example 22 | toner 22 | A | 1.47 | C | 1.36 | A | 96 | B | 93 | A | 0.04 | C | 0.12 |
| Example 23 | toner 23 | B | 1.42 | C | 1.35 | B | 91 | C | 85 | B | 0.07 | B | 0.09 |
| Comparative Example 1 | comparative toner 1 | B | 1.43 | D | 1.34 | C | 89 | D | 80 | A | 0.04 | B | 0.06 |
| Comparative Example 2 | comparative toner 2 | B | 1.42 | D | 1.33 | C | 88 | D | 80 | A | 0.04 | B | 0.07 |
| Comparative Example 3 | comparative toner 3 | A | 1.45 | D | 1.34 | C | 87 | E | 79 | A | 0.04 | B | 0.07 |
| Comparative Example 4 | comparative toner 4 | A | 1.46 | C | 1.38 | C | 89 | E | 78 | A | 0.03 | B | 0.10 |
| Comparative Example 5 | comparative toner 5 | A | 1.47 | D | 1.33 | C | 88 | E | 79 | A | 0.03 | B | 0.09 |

TABLE 6-continued

| | | High-temperature, High-humidity Environment | | | | | | | | | | | |
|---|---|---|---|---|---|---|---|---|---|---|---|---|---|
| | | Image Density | | | | Transferability | | | | Density Uniformity | | | |
| | | 1st | | 12,000 th | | 1st | | 12,000 th | | 1st | | 12,000 th | |
| Comparative Example 6 | comparative toner 6 | A | 1.46 | C | 1.38 | C | 88 | E | 78 | A | 0.04 | C | 0.11 |
| Comparative Example 7 | comparative toner 7 | B | 1.42 | D | 1.31 | C | 87 | E | 77 | A | 0.04 | B | 0.10 |
| Comparative Example 8 | comparative toner 8 | B | 1.40 | D | 1.25 | D | 80 | E | 75 | B | 0.09 | C | 0.18 |
| Comparative Example 9 | comparative toner 9 | A | 1.45 | D | 1.32 | A | 96 | E | 79 | A | 0.03 | C | 0.13 |

Examples 2 to 23 and Comparative Examples 1 to 9

Evaluations were performed in an analogous fashion as in Example 1. The results of the evaluations are given in Table 6.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246999, filed Dec. 28, 2018 which is hereby incorporated by reference herein in its entirety.

What is claimed is:

1. A toner, comprising:

a toner particle that contains a binder resin and a colorant;

a surface of said toner particle comprising fine particles A and fine particles B;

fine particles A containing an organosilicon polymer having a structure in which silicon atoms and oxygen atoms are alternately bonded to each other, with a content of fine particles A in the toner being 0.5 to 6.0 mass %;

fine particles B having a volume resistivity of 5.0×10 to $1.0\times10^{8}$ Ωm, with a content of fine particles B in the toner being 0.1 to 3.0 mass %, wherein a portion of silicon atoms in the organosilicon polymer has a T3 unit structure represented by $R^1$—$SiO_{3/2}$ where $R^1$ represents an alkyl group having 1 to 6 carbons or a phenyl group, a proportion for an area of a peak originating with silicon having the T3 unit structure with reference to a total area of all Si element-originating peaks is 0.50 to 1.00 in a $^{29}$Si-NMR measurement using the organosilicon polymer particles, of the fine particles A present at the surface of toner particle, when A1 is fine particles present embedded in the toner particle and A2 is fine particles present not embedded in the toner particle, a total coverage ratio of the surface of the toner particle by fine particles A1 and fine particles A2 is 10 to 70%, a percentage for an area occupied by fine particles A2 is at least 70 area % with reference to a total of an area occupied by fine particles A1 and the area occupied by fine particles A2 in observation of cross sections of 100 particles of the toner using a transmission electron microscope, in a surface vicinity region from a location 30 nm inside from the surface of the toner particle to an outermost surface of the toner, and of the fine particles B present at the surface of the toner particle, designating fine particles present embedded in the toner particle as a fine particles B1 and designating fine particles present not embedded in the toner particle as fine particles B2, a percentage for an area occupied by fine particles B2 is not more than 50 area % with reference to a total of an area occupied by fine particles B1 and the area occupied by fine particles B2 in observation of cross sections of 100 toner particles using a transmission electron microscope in the surface vicinity region from the location 30 nm inside from the surface of the toner particle to the outermost surface of the toner.

2. The toner according to claim 1, wherein fine particles A have a number-average primary particle diameter of 30 to 300 nm.

3. The toner according to claim 1, wherein fine particles A have a shape factor SF-1 of not greater than 114.

4. The toner according to claim 1, wherein fine particles B have a number-average primary particle diameter of 5 to 50 nm.

5. The toner according to claim 1, wherein the toner contains an ester wax having a melting point of 60 to 90° C. according to differential scanning calorimetry measurement.

6. The toner according to claim 1, wherein fine particles A at the toner surface have a dispersity evaluation index of 0.5 to 2.0, and fine particles B at the toner surface have a dispersity evaluation index of not greater than 0.4.

7. The toner according to claim 1, wherein the surface of the toner article further comprises silica fine particles C having a number-average primary particle diameter of 5 to 50 nm.

8. The toner according to claim 7, wherein of the fine particles C present at the toner particle surface, when C1 is fine particles present embedded in the toner particle and C2 is fine particles present not embedded in the toner particle a percentage for an area occupied by the fine particles C2 is at least 70 area % with reference to a total of an area occupied by the fine particles C1 and the area occupied by the fine particles C2 in observation of cross sections of 100 particles of the toner using a transmission electron microscope in the surface vicinity region from the location 30 nm inside from the toner particle surface to the outermost surface of the toner.

9. The toner according to claim 1, wherein the fine particles B comprise at least one selected from the group consisting of titanium oxide, strontium titanate and alumina fine particles.

10. A toner, comprising:

a toner particle that contains a binder resin and a colorant;

a surface of said toner particle comprising fine particles A and fine particles B;

fine particles A containing an organosilicon polymer having a structure in which silicon atoms and oxygen atoms are alternately bonded to each other, with a content of fine particles A in the toner being 0.5 to 6.0 mass %;

the fine particles B contain at least one of titanium oxide and strontium titanate, with a content of fine particle B in the toner being 0.1 to 3.0 mass % wherein a portion of silicon atoms contained in the organosilicon polymer has a T3 unit structure represented by $R^1$—$SiO_{3/2}$ where $R^1$ represents an alkyl group having 1 to 6 carbons or a phenyl group, a proportion for an area of a peak originating with silicon having the T3 unit structure with reference to a total area of all Si element-originating peaks is 0.50 to 1.00 in a $^{29}$Si-NMR measurement using the organosilicon polymer particles, of the fine particles A present at the surface of the toner particle, when A1 is fine particles present embedded in the toner particle and A2 is fine particles present not embedded in the toner particle, a total coverage ratio of the toner by fine particles A1 and fine particles A2 is 10 to 70%, a percentage for an area occupied by fine particles A2 is at least 70 area % with reference to a total of an area occupied by fine particles A1 and the area occupied by fine particles A2 in observation of cross sections of 100 particles of the toner using a transmission electron microscope, in a surface vicinity region from a location 30 nm inside from the surface of the toner particle to an outermost surface of the toner, and of the fine particles B present at the surface of the toner particle, designating fine particles present embedded in the toner particle as fine particles B1 and designating fine particles present not embedded in the toner particle as fine particles B2, a percentage for an area occupied by fine particles B2 is not more than 50 area % with reference to a total of an area occupied by fine particles B1 and the area occupied by fine particles B2 in observation of cross sections of 100 toner particles using a transmission electron microscope in the surface vicinity region from the location 30 nm inside from the surface of the toner particle to the outermost surface of the toner.

* * * * *